US010042305B2

(12) United States Patent
Kawaguchi

(10) Patent No.: US 10,042,305 B2
(45) Date of Patent: Aug. 7, 2018

(54) SHEET PROCESSING DEVICE AND SHEET PROCESSING METHOD

(71) Applicants: KABUSHIKI KAISHA TOSHIBA, Tokyo (JP); TOSHIBA TEC KABUSHIKI KAISHA, Tokyo (JP)

(72) Inventor: Takahiro Kawaguchi, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 42 days.

(21) Appl. No.: 15/392,564

(22) Filed: Dec. 28, 2016

(65) Prior Publication Data

US 2018/0181050 A1 Jun. 28, 2018

(51) Int. Cl.
*G03G 15/00* (2006.01)

(52) U.S. Cl.
CPC ..... *G03G 15/6544* (2013.01)

(58) Field of Classification Search
CPC ..... G03G 15/6529; G03G 15/6538; G03G 15/6544; B65H 37/04; B65H 29/20; B65H 2301/51611; B65H 2801/27
See application file for complete search history.

(56) References Cited

U.S. PATENT DOCUMENTS 6,142,469 A * 11/2000 Nanba ..... B65H 31/10 270/52.03
6,241,234 B1 * 6/2001 Saitoh ..... B65H 33/08 270/58.12
6,244,583 B1 * 6/2001 Ohmichi ..... B65H 29/22 270/58.07
7,192,020 B2 * 3/2007 Hayashi ..... B42C 1/12 270/58.01
7,354,036 B2 * 4/2008 Hayashi ..... B42C 1/12 270/58.01
7,552,917 B2 * 6/2009 Hayashi ..... B42C 1/12 270/58.01
7,866,647 B2 1/2011 Terao et al.
8,267,399 B2 * 9/2012 Kushida ..... B65H 31/3027 270/58.12
8,814,157 B2 * 8/2014 Gamo ..... B65H 31/02 270/58.12
9,150,378 B2 * 10/2015 Shimura ..... B65H 39/00
2010/0150636 A1 * 6/2010 Kubota ..... B42C 1/12 399/407

(Continued)

*Primary Examiner* — David Banh
(74) *Attorney, Agent, or Firm* — Patterson & Sheridan, LLP

(57) ABSTRACT

A sheet processing device includes a standby tray, a sheet post-processing unit, a first pressing member, a second pressing member, and a control unit. The control unit is configured to control the first pressing member to press a first sheet conveyed into the standby tray at a first location, cause the first sheet to be conveyed upstream to a first position, control the second pressing member to press the first sheet at a second location, cause a second sheet to be conveyed on top of the first sheet while the first sheet is no longer pressed by the first pressing member but is still pressed by the second pressing member, press the second sheet at the first location, and cause the first sheet to be conveyed upstream to a second position that is offset from the first position.

20 Claims, 16 Drawing Sheets

(56) References Cited

U.S. PATENT DOCUMENTS

| | | | | |
|---|---|---|---|---|
| 2015/0165809 | A1* | 6/2015 | Komiyama | B42B 5/08<br>412/38 |
| 2015/0183610 | A1* | 7/2015 | Matsuki | B65H 37/04<br>270/58.08 |
| 2015/0310316 | A1* | 10/2015 | Osada | G06K 15/16<br>358/1.12 |

* cited by examiner

SHEET PROCESSING DEVICE AND SHEET PROCESSING METHOD

FIELD

Embodiments described herein relate generally to a sheet processing device and a sheet processing method.

BACKGROUND

Generally, a sheet processing device performs specified post-processing on a sheet conveyed from an image forming apparatus. The sheet processing device includes a processing unit for performing the post-processing. A standby unit is provided above the processing unit. The standby unit temporarily holds a subsequent sheet while post-processing on the sheet is performed by the processing unit. When the processing unit is available, the standby unit drops the held sheet toward the processing unit.

A sheet bundle may be bound with an adhesive tape, and sheets of the sheet bundle may be incrementally shifted with respect to each other such that an end of the sheet bundle forms a step shape. In this case, an adhesion area of intermediate sheets of the sheet bundle with respect to the adhesive tape can be increased. However, it is difficult to shift the end of the sheet bundle to form the step shape, and a configuration of the device is likely to be complicated.

DETAILED DESCRIPTION

Figure 1:
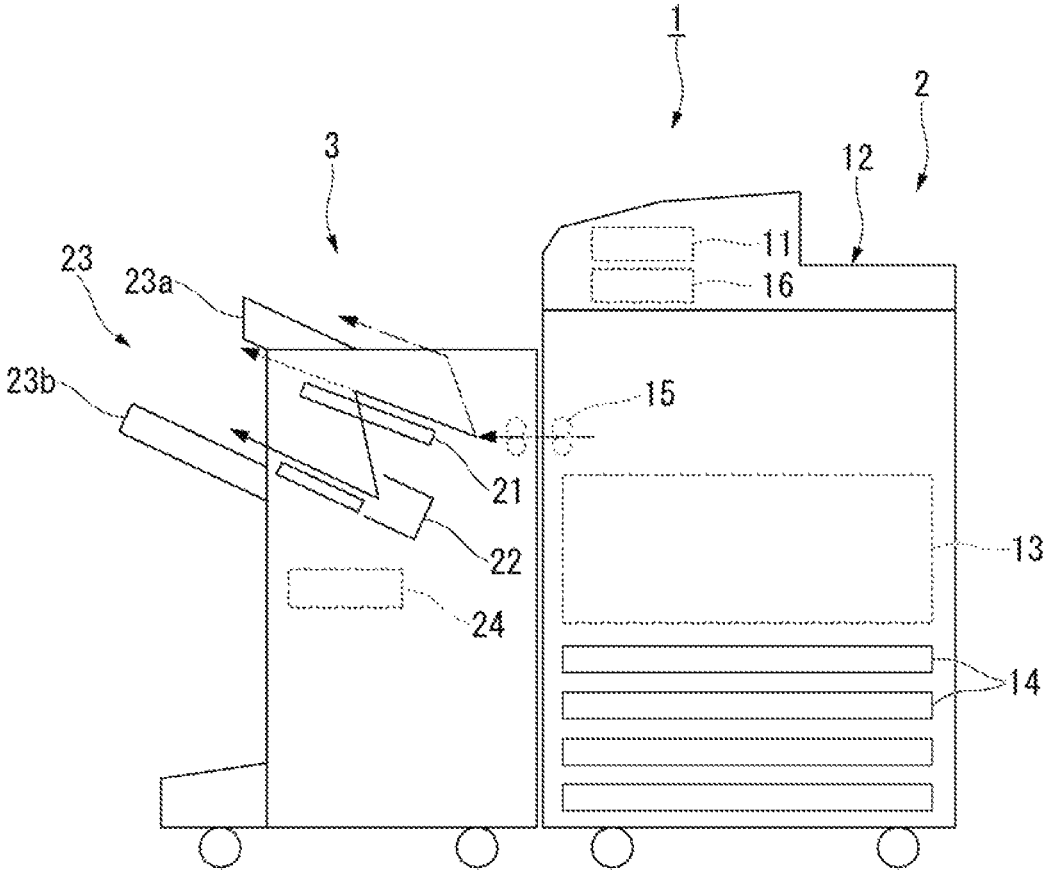
FIG. 1 is a front view illustrating an example configuration of an image forming system according to an embodiment.

A sheet processing device according to an embodiment includes a standby tray, a sheet post-processing unit configured to perform a specified post-processing on a sheet bundle held in the standby tray, a first pressing member configured to press the sheet bundle against the standby tray at a first location of the standby tray, a second pressing member configured to press the sheet bundle against the standby tray at a second location of the standby tray which is upstream in a sheet conveying direction relative to the first location, and a control unit. The control unit is configured to control the first pressing member to press a first sheet conveyed into the standby tray against the standby tray at the first location of the standby tray, cause the first sheet while pressed by the first pressing member to be conveyed upstream in the sheet conveying direction to a first position on the standby tray, control the second pressing member to press the first sheet against the standby tray at the second location of the standby tray while the first sheet is at the first position, control the first pressing member to stop pressing the first sheet against the standby tray, cause a second sheet to be conveyed on top of the first sheet while the first sheet is no longer pressed by the first pressing member and is still pressed by the second pressing member, control the first pressing member to press the second sheet against the standby tray at the first location, and cause the second sheet while pressed by the first pressing member and while the first sheet is pressed by the second pressing member to be conveyed upstream in the sheet conveying direction to a second position on the standby tray that is offset from the first position.

A sheet processing method according to an embodiment includes the steps of: pressing a first sheet conveyed into a standby tray against the standby tray at a first location of the standby tray; while the first sheet is being pressed, conveying the first sheet upstream in a sheet conveying direction to a first position on the standby tray; while the first sheet is at the first position, pressing the first sheet against the standby tray at a second location of the standby tray which is upstream in a sheet conveying direction relative to the first location; stopping the pressing of the first sheet against the standby tray at the first location; conveying a second sheet on top of the first sheet while the first sheet is no longer pressed at the first location and is still pressed at the second location; pressing the second sheet against the standby tray at the first location; and while the second sheet is pressed at the first location and while the first sheet is pressed at the second location, conveying the second sheet upstream in the sheet conveying direction to a second position on the standby tray that is offset from the first position.

In the following, a sheet processing device according to an embodiment will be described with reference to the drawings. In the following description, same reference numerals are given to configurations having identical or similar functions. Redundant description of the configurations can be omitted.

Figure 2:
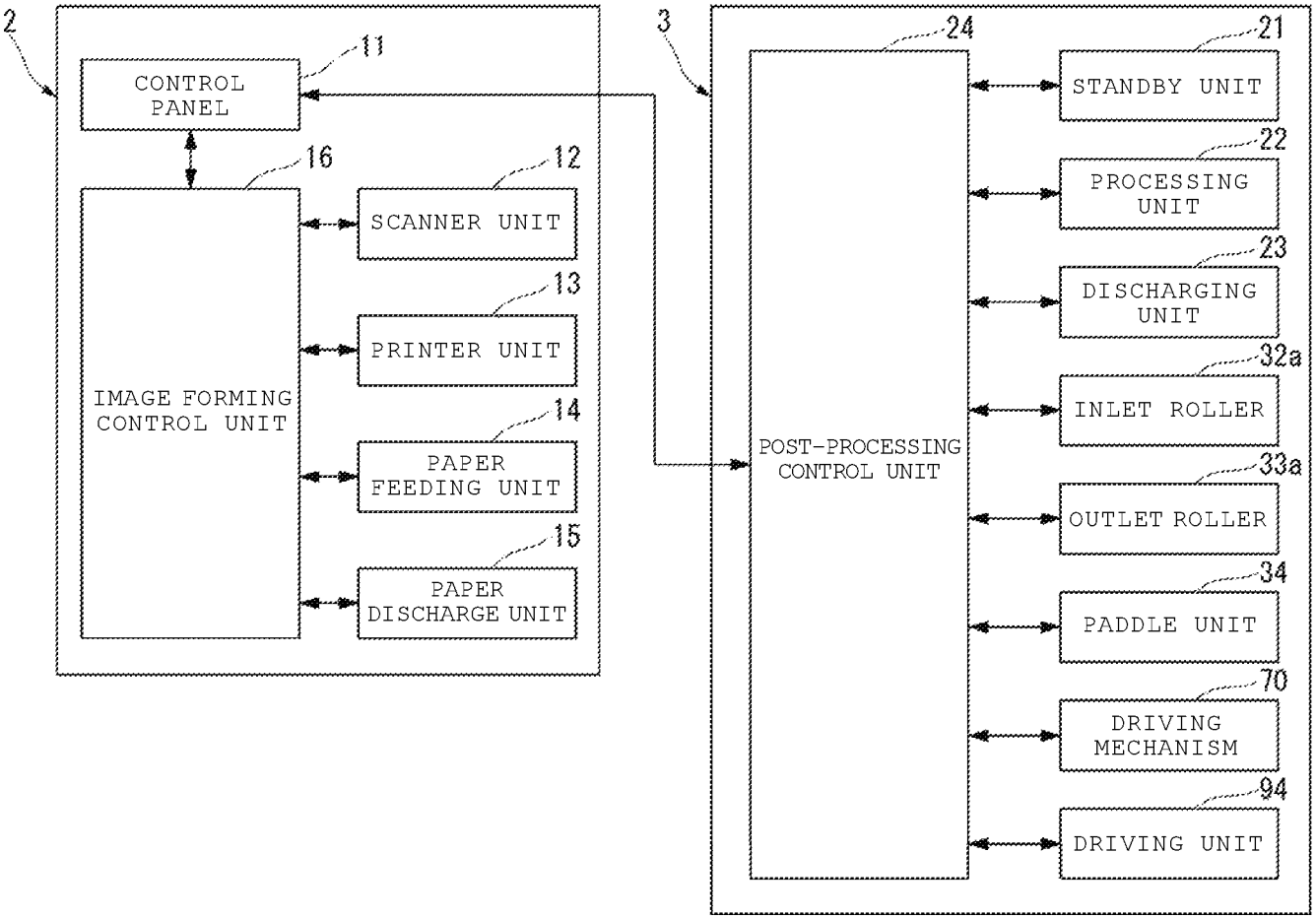
FIG. 2 is a block diagram illustrating an example configuration of the image forming system.

A sheet processing device according to one embodiment will be described with reference to FIGS. 1-16. First, FIG. 1 and FIG. 2 illustrate an example configuration of an image forming system 1. The image forming system 1 includes an image forming apparatus 2 and a post-processing device 3. The image forming apparatus 2 forms an image on a sheet type recording medium such as a paper sheet (hereafter, a "sheet S"). The post-processing device 3 performs post-processing on the sheet S conveyed from the image forming apparatus 2. The post-processing device 3 is an example of a "sheet processing device."

The image forming apparatus 2 includes a control panel 11, a scanner unit 12, a printer unit 13, a paper feeding unit 14, a paper discharge unit 15, and an image forming control unit 16.

The control panel 11 includes various keys, touch panels, or the like, for receiving the user's operation. For example, the control panel 11 receives input regarding a type of post-processing for the sheet S. The image forming apparatus 2 transmits information about the type of post-processing input by the control panel 11 to the post-processing device 3.

The scanner unit 12 includes a reading unit that generates image information of an object to be copied. The scanner unit 12 transmits the image information to the printer unit 13.

The printer unit 13 forms an output image (in the following, referred to as a "toner image") with a developer such as a toner based on the image information transmitted from the scanner unit 12 or from an external device. The printer unit 13 transfers the toner image onto a surface of the sheet S. The printer unit 13 applies heat and pressure to the toner image transferred onto the sheet S to fix the toner image onto the sheet S.

The paper feeding unit 14 supplies additional sheets S one by one to the printer unit 13 as the printer unit 13 forms toner images on each sheet S.

The paper discharge unit 15 conveys the sheet S discharged from the printer unit 13 to the post-processing device 3.

The image forming control unit 16 controls the entire operation of the image forming apparatus 2. That is, the image forming control unit 16 controls the control panel 11, the scanner unit 12, the printer unit 13, the paper feeding unit 14, and the paper discharge unit 15. The image forming control unit 16 includes a central processing unit (CPU), a read only memory (ROM), and a random access memory (RAM).

Next, the post-processing device 3 will be described.

First, the entire configuration of the post-processing device 3 will be described. As illustrated in FIG. 1, the post-processing device 3 is positioned adjacent to the image forming apparatus 2. The post-processing device 3 executes post-processing designated through the control panel 11 on the sheet S conveyed from the image forming apparatus 2. For example, the post-processing may include sheet binding processing, sort processing, or the like.

The post-processing device 3 includes a standby unit 21, a processing unit 22, a discharging unit 23, and a post-processing control unit (control unit) 24.

The standby unit 21 temporarily holds the sheet S (see FIG. 3) conveyed from the image forming apparatus 2. For example, the standby unit 21 may hold a plurality of subsequent sheets S while the post-processing of the preceding sheet S is performed by the processing unit 22. The standby unit 21 is provided above the processing unit 22. For example, the standby unit 21 may stack a plurality of sheets S to form a sheet bundle SS. When the processing unit 22 is available, the standby unit 21 drops the stayed sheet S toward the processing unit 22.

The processing unit 22 performs the post-processing on the conveyed sheet S. For example, the processing unit 22 may align the plurality of sheets S. As another example, the processing unit 22 may perform sheet binding processing on the sheet bundle SS formed by the standby unit 21, with an adhesive tape. The processing unit 22 discharges the sheet S subjected to the post-processing to the discharging unit 23.

The discharging unit 23 includes a fixed tray 23*a* and a movable tray 23*b*. The fixed tray 23*a* is provided on an upper part of the post-processing device 3. The movable tray 23*b* is provided on a side part of the post-processing device 3. The sheet S subjected to the post-processing is discharged to the fixed tray 23*a* and the movable tray 23*b*.

The post-processing control unit 24 controls an operation of the entirety of the post-processing device 3. That is, the post-processing control unit 24 controls the standby unit 21, the processing unit 22, and the discharging unit 23. As illustrated in FIG. 2, the post-processing control unit 24 controls inlet rollers 32*a* and 32*b*, outlet rollers 33*a* and 33*b*, a paddle unit 34, a driving mechanism 70 of an assist guide 43, and a driving unit 94 of an end chuck 90 which will be described later. The post-processing control unit 24 includes a CPU, ROM, and RAM similar to the image forming control unit 16.

Next, the configuration of each unit of the post-processing device 3 will be described in detail.

A "sheet conveyance direction" referred to in the present disclosure means a conveyance direction D of the sheet S to the standby tray 41 of the standby unit 21. An "upstream side" and a "downstream side" referred to in the present disclosure means an upstream side and a downstream side in the sheet conveyance direction D, respectively. A "tip portion" and an "end portion" referred to in the present disclosure mean a "downstream end portion" and an "upstream end portion" in the sheet conveyance direction D, respectively. In the present disclosure, a direction which is substantially parallel to an upper surface (conveyance surface) 45*b* of the standby tray 41 and substantially orthogonal to the sheet conveyance direction D is referred to as a sheet width direction W.

Figure 3:
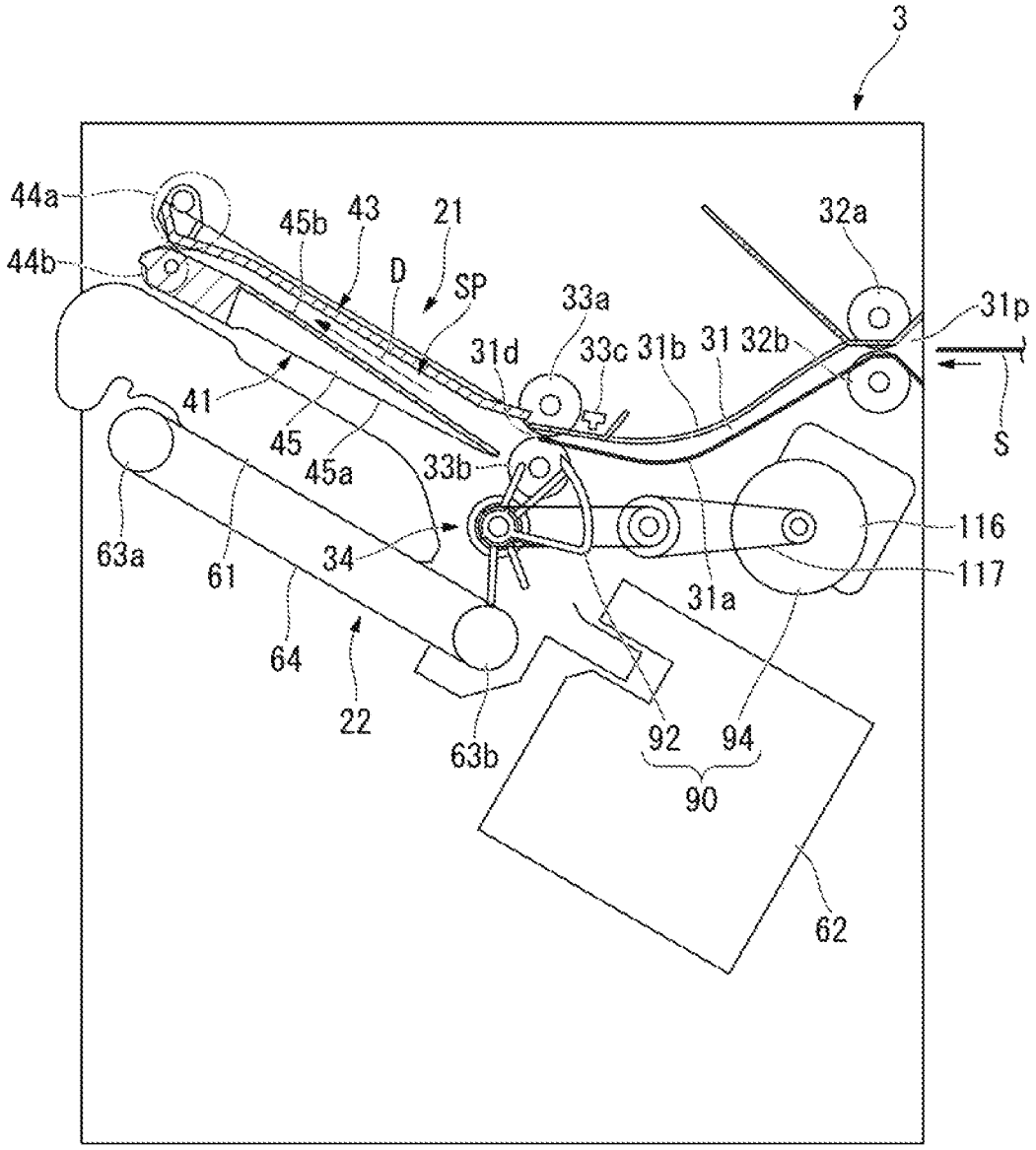
FIG. 3 is a sectional view illustrating an example configuration of a post-processing device of the image forming system.

FIG. 3 schematically illustrates a configuration of the post-processing device 3. As illustrated in FIG. 3, the post-processing device 3 includes a conveyance passage 31 of the sheet S, the pair of inlet rollers 32*a* and 32*b*, the pair of outlet rollers 33*a* and 33*b*, the standby unit 21, the paddle unit 34, and the processing unit 22.

The conveyance passage 31 is inside the post-processing device 3. For example, the conveyance passage 31 may be formed by a first guide member 31*a* and a second guide member 31*b*. The first guide member 31*a* forms a lower surface of the conveyance passage 31. The second guide member 31*b* is positioned opposite to the first guide member 31*a*, across the conveyance passage 31. The second guide member 31*b* forms the upper surface of the conveyance passage 31. The conveyance passage 31 includes a sheet supply port 31*p* and a sheet discharge port 31*d*. The sheet supply port 31*p* faces the image forming apparatus 2. The sheet S is supplied to the sheet supply port 31*p* from the image forming apparatus 2. The sheet discharge port 31*d* is positioned near the standby unit 21. The sheet S passing through the conveyance passage 31 is discharged to the standby unit 21 from the sheet discharge port 31*d*.

The inlet rollers 32*a* and 32*b* are provided near the sheet supply port 31*p*. The inlet rollers 32*a* and 32*b* are arranged parallel to each other and on opposite sides of the conveyance passage 31. The inlet roller 32*a* is a driving roller disposed on the upper surface side of the conveyance passage 31. The inlet roller 32*b* is a driven roller disposed on the lower surface side of the conveyance passage 31. The sheet S is pinched between the inlet rollers 32*a* and 32*b*. The inlet rollers 32*a* and 32*b* convey the sheet S supplied to the sheet supply port 31*p* toward the downstream side of the conveyance passage 31. The inlet rollers 32*a* and 32*b* convey the sheet S to the outlet rollers 33*a* and 33*b*.

The outlet rollers 33*a* and 33*b* are provided near the sheet discharge port 31*d*. The outlet rollers 33*a* and 33*b* are arranged in parallel to each other and on opposite sides of the conveyance passage 31. The outlet roller 33*a* is a driving roller disposed on the upper surface side of the conveyance passage 31. The outlet roller 33*b* is a driven roller disposed on the lower surface side of the conveyance passage 31. The sheet S is pinched between the outlet rollers 33*a* and 33*b*. The outlet rollers 33*a* and 33*b* convey the sheet S conveyed by the inlet rollers 32*a* and 32*b* from the sheet discharge port 31*d* toward the standby unit 21.

Next, the standby unit 21 will be described.

The standby unit 21 includes the standby tray 41, an opening and closing driving unit 42 (see FIG. 4), the assist guide 43, and discharge rollers 44*a* and 44*b*.

A rear portion of the standby tray 41 is positioned near the outlet rollers 33*a* and 33*b*. The rear portion of the standby tray 41 is positioned below the sheet discharge port 31*d* of the conveyance passage 31. The standby tray 41 is inclined with respect to the horizontal direction such that the standby tray 41 is higher on the downstream side in the sheet conveyance direction D. The standby tray 41 stacks a plurality of sheets S to be held in a standby state while the post-processing is performed by the processing unit 22.

The standby tray 41 includes a bottom wall 45 and sidewalls (not illustrated). The bottom wall 45 includes a lower surface 45*a* and an upper surface (conveyance surface) 45*b*. The bottom wall 45 supports the sheet S from below. The sidewall supports a side of the sheet S in the sheet width direction W. The upper surface 45*b* supports the sheet S held in the standby unit 21.

Figure 4:
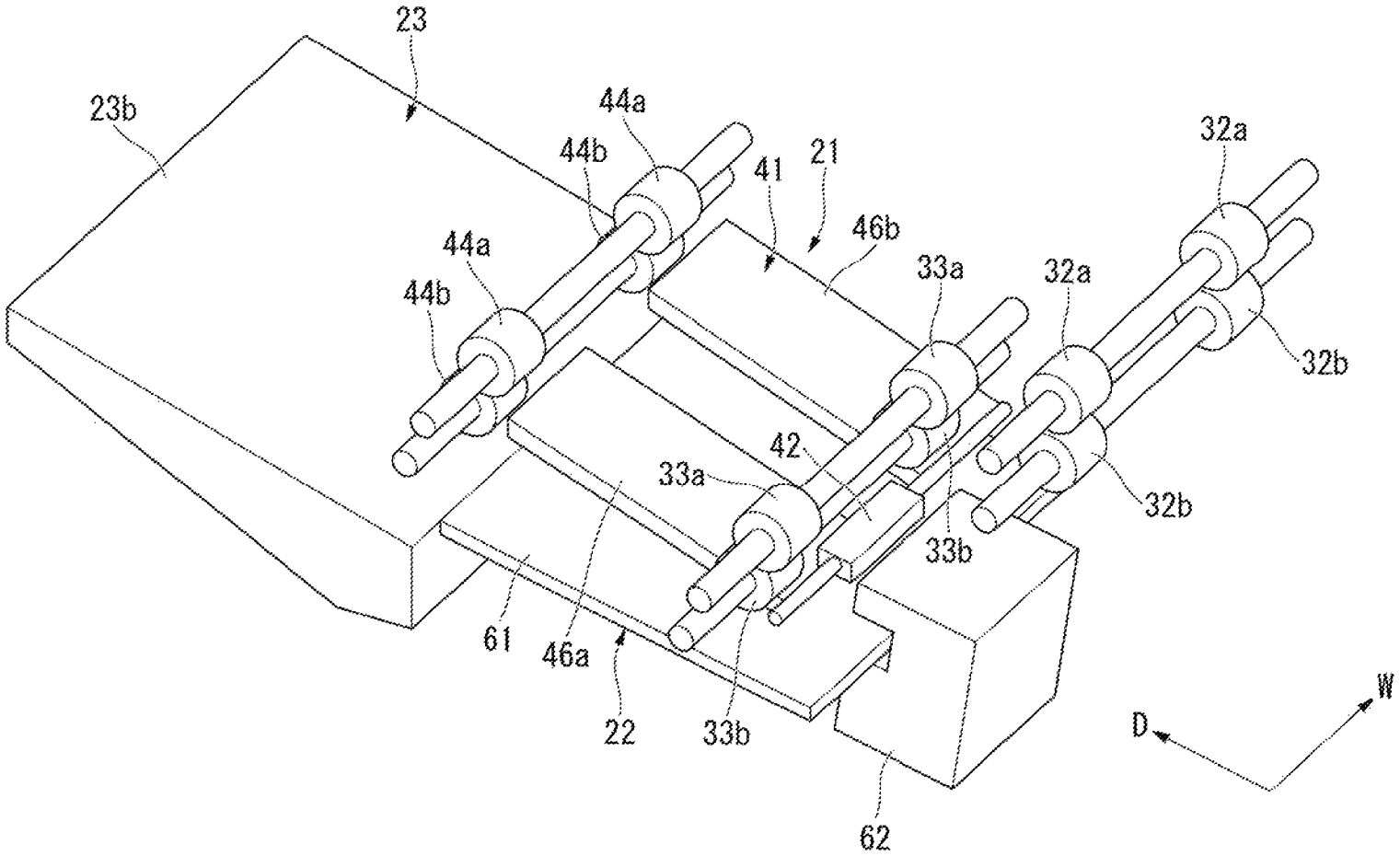
FIG. 4 is a perspective view illustrating an example standby unit and processing unit of the post-processing device.

FIG. 4 schematically illustrates the standby tray 41. As illustrated in FIG. 4, the standby tray 41 includes a first tray member 46*a* and a second tray member 46*b*. The first tray member 46*a* and the second tray member 46*b* are separated from each other in the sheet width direction W. The first tray member 46*a* and the second tray member 46*b* are movable in the sheet width direction W so that the first tray member 46*a* and the second tray member 46*b* can move towards each other and move away from each other.

Specifically, the opening and closing driving unit 42 can drive the first tray member 46*a* and the second tray member 46*b* in the sheet width direction W so that the first tray member 46*a* and the second tray member 46*b* move towards each other and move away from each other. When the sheet S is in a standby state in a standby tray 41, the opening and closing driving unit 42 causes the first tray member 46*a* and the second tray member 46*b* relatively close together. With this, the sheet S is supported by the first tray member 46*a* and the second tray member 46*b*. On the other hand, when the sheet S is moved from the standby tray 41 toward a processing tray 61 of the processing unit 22, the opening and closing driving unit 42 causes the first tray member 46*a* and the second tray member 46*b* to be separated from each other. With this, the sheet S supported by the standby tray 41 drops down from a gap between the first tray member 46*a* and the second tray member 46*b* toward the processing tray 61. Accordingly, the sheet S is moved from the standby tray 41 to the processing tray 61.

Figure 5:
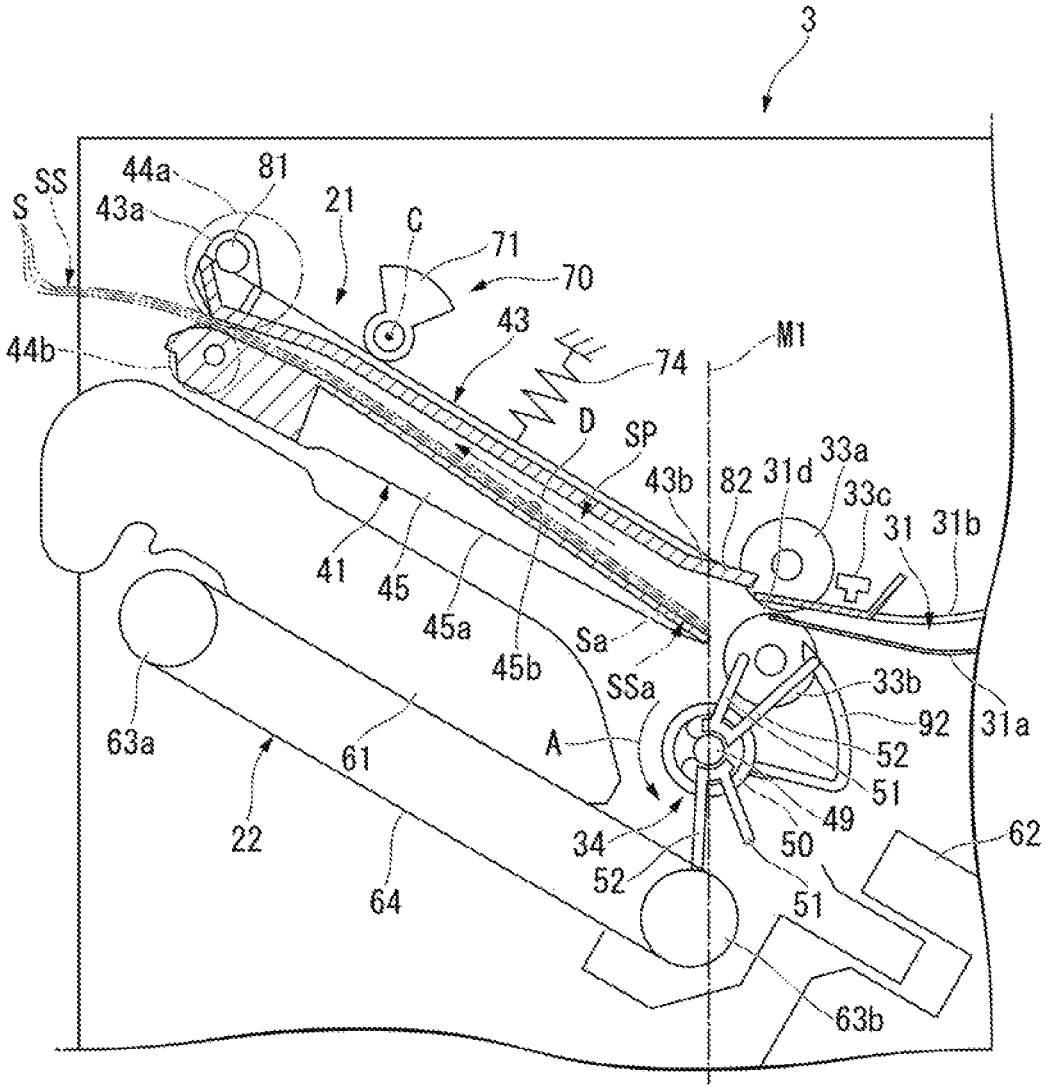
FIG. 5 is a sectional view illustrating the standby unit and the processing unit.

FIG. 5 illustrates the assist guide 43 on an enlarged scale. As illustrated in FIG. 5, the assist guide 43 is provided above the standby tray 41. For example, a length of the assist guide 43 may be substantially the same length as that of the standby tray 41 in the sheet conveyance direction D. The assist guide 43 is a plate shaped member positioned above the standby tray 41 (see FIG. 7). The sheet S discharged from the outlet rollers 33*a* and 33*b* enters the gap between the assist guide 43 and the standby tray 41. The sheet S entering the standby unit 21 is guided by the assist guide 43 and the standby tray 41 and advances toward the downstream side of the standby unit 21.

When the sheet S is moved toward the processing tray 61 from the standby tray 41, the assist guide 43 urges the sheet S toward the processing tray 61. Specifically, the assist guide 43 is movable between a standby position (see FIG. 5) and a protruding position (see FIG. 6) moved downward with respect to the standby position. In the standby position, the entirety of the assist guide 43 is positioned above the standby tray 41. In the standby position, the assist guide 43 is positioned above the sheet discharge port 31*d* of the conveyance passage 31. On the other hand, in the protruding position, at least a portion of the assist guide 43 protrudes below the lower surface 45*a* of the standby tray 41. When the sheet S is moved toward the processing tray 61 from the standby tray 41, the assist guide 43 is moved from the standby position to the protruding position so as to urge the sheet S toward the processing tray 61. When the sheet S is placed on the standby tray 41, the assist guide 43 moves to an intermediate position (hereafter, referred to as a pressing position) between the standby position and the protruding position so as to urge the sheet S toward the standby tray 41.

As illustrated in FIG. 5, the assist guide 43 includes a first end portion 43*a* and a second end portion 43*b* in the sheet conveyance direction D. The first end portion 43*a* is on a downstream side of the assist guide 45 in the sheet conveyance direction D. The second end portion 43*b* is on an upstream end of the assist guide 45 in the sheet conveyance direction D.

The first end portion 43*a* includes a rotating shaft 81 which is a rotation fulcrum (rotation center) of the assist guide 43. The rotating shaft 81 is provided at a position which is substantially close to the tip portion of the standby tray 41 in the sheet conveyance direction D. For example, the rotating shaft 81 is positioned near the discharge roller 44*a* positioned above the standby tray 41.

The second end portion 43*b* forms a pushing portion 82 for contacting the sheet S. When the sheet S is moved toward the processing tray 61 from the standby tray 41, the assist guide 43 is rotated around the rotating shaft 81 so that the pushing portion 82 pushes the upstream side of the sheet S toward the processing tray 61.

The pushing portion 82, as illustrated in FIG. 5, is positioned near the sheet discharge port 31*d* of the conveyance passage 31. For example, the pushing portion 82 overlaps a vertical line M1 passing through an axial center of a rotation shaft 49 of the paddle unit 34 (which will be described later) in a side view of FIG. 5. That is, the pushing portion 82 is closer to the sheet discharge port 31*d* than the vertical line M1.

Figure 6:
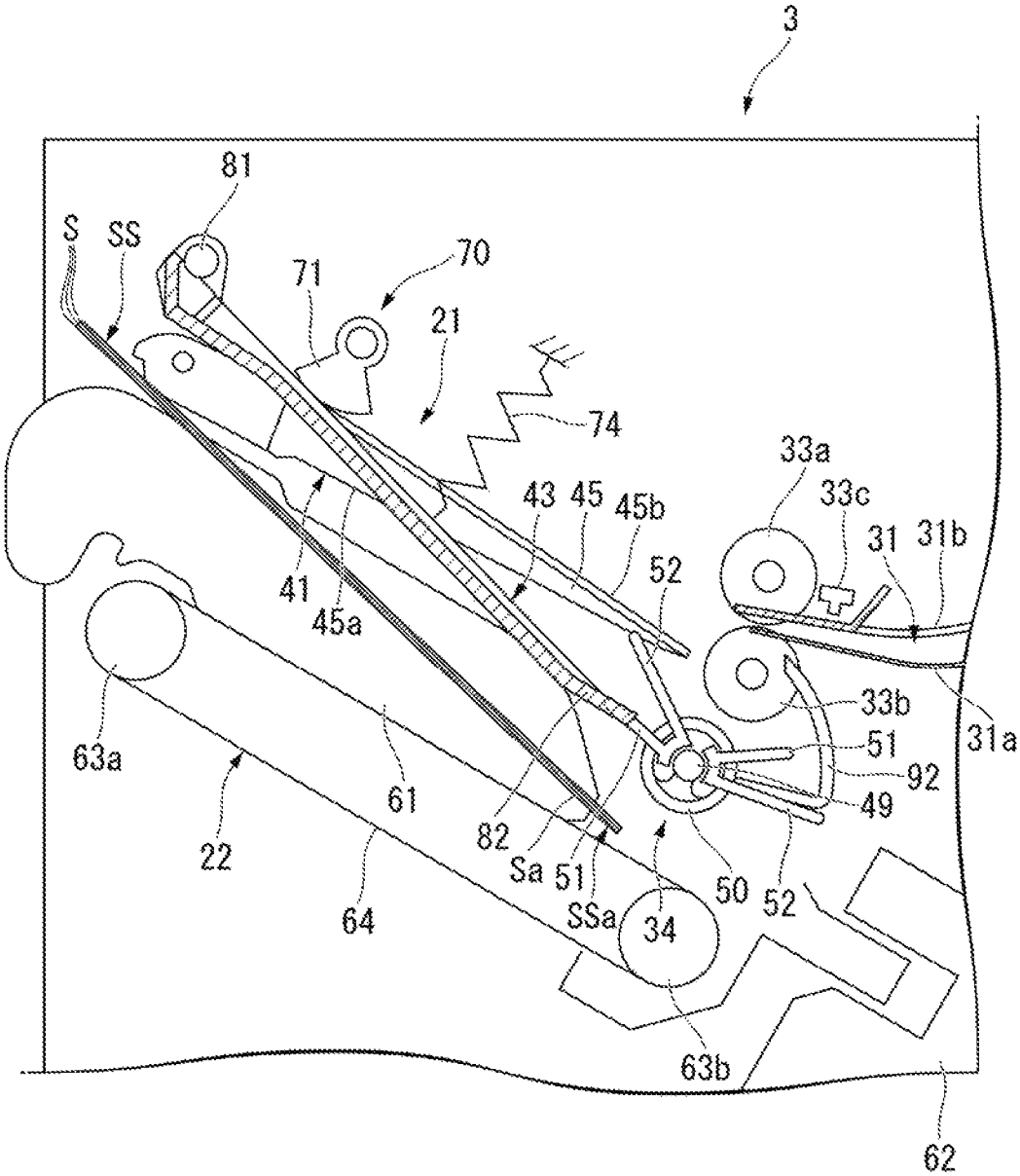
FIG. 6 is a sectional view illustrating the standby unit, the processing unit with an operation example.

FIG. 6 illustrates the assist guide 43 in the protruding position. As illustrated in FIG. 6, the pushing portion 82 pushes an end portion Sa of the sheet S toward (downward) the processing tray 61.

Next, the driving mechanism 70 driving the assist guide 43 will be described.

As illustrated in FIG. 5, the driving mechanism 70 includes a driving member 71, a driving source 72 (see FIG. 7), and a power transmission mechanism 73 (see FIG. 7), and a spring 74.

The driving member 71 moves the assist guide 43 from the standby position to the protruding position or the pressing position. For example, the driving member 71 may be a cam. A rotation center C of the driving member 71 is positioned above the standby tray 41. The driving member 71 has an outer circumferential surface that is eccentrically arranged with respect to the rotation center C. The driving member 71 rotates around the rotation center C so as to contact the upper surface of the assist guide 43. The driving member 71 further rotates so that the driving member 71 contacts the upper surface of the assist guide 43 and presses the assist guide 43 downward. With this, the driving member 71 moves the assist guide 43 from the standby position to the protruding position or the pressing position.

Figure 7:
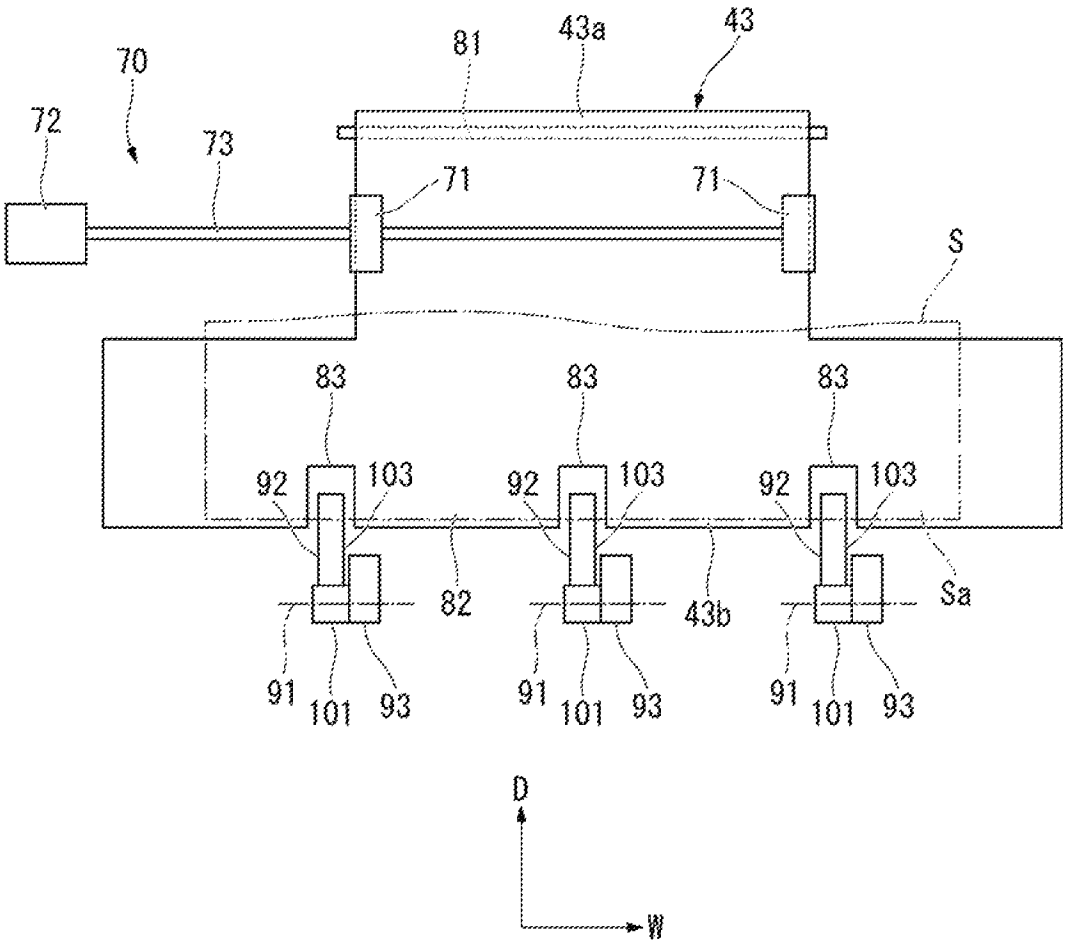
FIG. 7 is a plan view illustrating an assist guide and a pressing member.

FIG. 7 is a plan view of the assist guide 43. As illustrated in FIG. 7, the driving member 71 is connected to the driving source 72 through the power transmission mechanism 73. The driving source 72 is, for example, a pulse motor. The driving source 72 rotates the driving member 71 through the power transmission mechanism 73.

As illustrated in FIG. 5, the spring 74 is provided above the assist guide 43. The spring 74 urges the assist guide 43 upward. When pressing-down by the driving member 71 is released, the assist guide 43 moved to the protruding position is returned to the standby position by an urging force of the spring 74.

As illustrated in FIG. 5, the discharge rollers 44*a* and 44*b* are provided near the tip portion of the standby tray 41. The discharge rollers 44*a* and 44*b* are arranged parallel to each other and on opposite sides of the standby tray 41. The discharge roller 44*a* is a driving roller arranged on an upper surface side of the standby tray 41. The discharge roller 44*b* is a driven roller arranged on a lower surface side of the standby tray 41. The sheet S is pinched between the discharge rollers 44*a* and 44*b*. When the sheet S is directly discharged from the standby tray 41 to the discharging unit 23, the discharge roller 44*a* forward rotates and conveys the sheet S toward the movable tray 23*b* of the discharging unit 23. When the sheets S are stacked on a specified position on the standby tray 41, the discharge roller 44*a* reverse rotates to allow the sheets S to be aligned.

Next, the paddle unit 34 will be described.

As illustrated in FIG. 5, the paddle unit 34 is arranged between the standby tray 41 and the processing tray 61. The paddle unit 34 is provided below the standby tray 41. When the sheet S is moved toward the processing tray 61 from the standby tray 41, the paddle unit 34 rotates around the rotation shaft 49 and pushes the sheet S toward the processing tray 61. The paddle unit 34 moves the sheet S dropped down to the processing tray 61 toward a predetermined position in the processing unit 22. The paddle unit 34 includes the rotation shaft 49, a rotating body 50, a plurality of first paddles 51, and a plurality of second paddles 52.

The rotation shaft 49 corresponds to a rotation center of the paddle unit 34. The rotation shaft 49 is positioned below the standby tray 41. The rotation shaft 49 extends in the sheet width direction W. The paddle unit 34 rotates around the rotation shaft 49 in a direction indicated by arrow A (counterclockwise direction) in FIG. 5.

The rotating body 50 is formed in a cylindrical shape. The rotating body 50 rotates around the rotation shaft 49. The first paddles 51 and the second paddles 52 are attached to the rotating body 50.

The first paddles 51 and the second paddles 52 radially protrude from the rotating body 50. The first paddles 51 and the second paddles 52 are formed of an elastomeric material such as rubber. For example, the first paddles 51 may be rotated in accordance with the timing when the sheet S is moved from the standby tray 41 toward the processing tray 61. The first paddles 51 are rotated as described above to push the sheet S toward the processing tray 61. Thus, even when the sheet S adheres to the assist guide 43 with static electricity, the sheet S can be securely removed from the assist guide 43.

The second paddles 52 are positioned on the paddle unit 34 displaced circumferentially with respect to the first paddles 51 in the direction of arrow A. A radial length of each second paddle 52 is longer than a radial length of each first paddle 51, with respect to the radial direction of the rotating body 50. The second paddles 52 are rotated around the rotation shaft 49 and contact the upper surface of the uppermost sheet S among the plurality of sheets S dropped down to the processing tray 61. The second paddles 52 are further rotated while in contact with the upper surface of the sheet S so as to move the sheet S in the sheet conveyance direction D.

Next, the processing unit 22 will be described.

The processing unit 22 includes the processing tray 61, a tape binding unit 62, conveying rollers 63*a* and 63*b*, and a conveying belt 64.

The processing tray 61 is positioned below the standby tray 41. The processing tray 61 is inclined with respect to the horizontal direction such that the processing tray 61 is higher on the downstream side in the sheet conveyance direction D. For example, the processing tray 61 may be inclined substantially parallel to the standby tray 41. The plurality of sheets S moved to the processing tray 61 may be aligned in the sheet width direction Wand the sheet conveyance direction D by an aligning plate or the like. The processing unit 22 presses the sheet bundle SS on the processing tray 61 against an end stopper 62*a* provided in the upstream inside of the processing unit 22.

Figure 16:
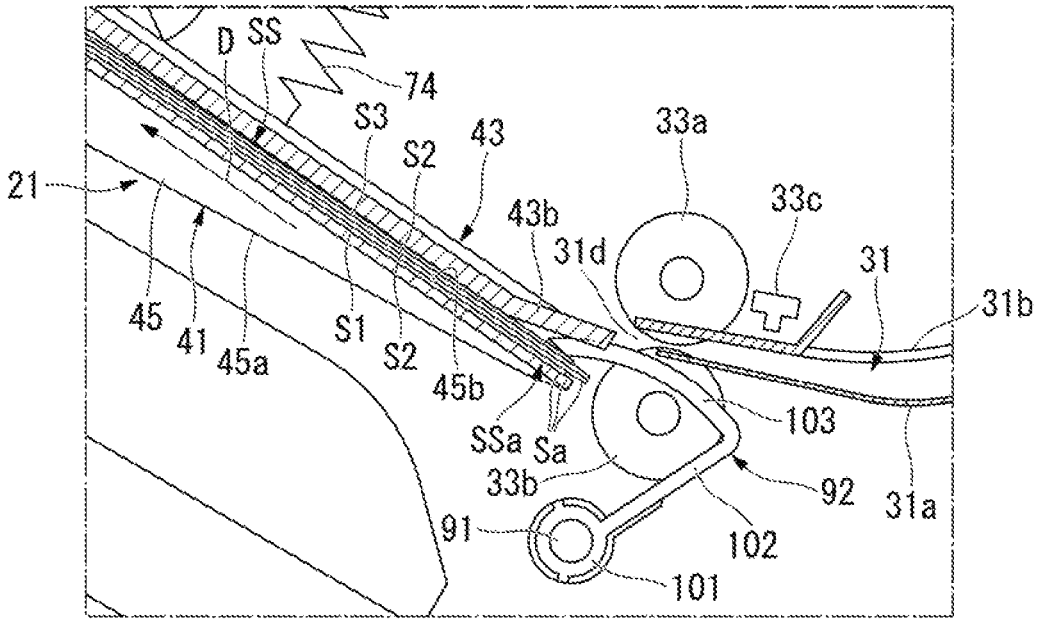
FIG. 16 is a sectional view illustrating an operation example of the post-processing device.

As illustrated in FIG. 16, for example, the sheet bundle SS may be formed by a first sheet S1, a second sheet S2, and a third sheet S3, in order from the standby tray 41 side.

The first sheet S1 is positioned on the standby tray 41 and is a front cover of the sheet bundle SS. The first sheet S1 is a sheet S in the sheet bundle SS that was conveyed first.

The third sheet S3 is positioned on top of the first sheet S1 and second sheet S2 on the standby tray 41 and is a back cover of the sheet bundle SS. The third sheet S3 is a sheet S in the sheet bundle SS that was conveyed last.

The second sheet S2 is positioned between the first sheet S1 and the third sheet S3 on the standby tray 41 and is an intermediate-page sheet of the sheet bundle SS. The second sheet S2 can be a single sheet or a plurality of sheets. The sheet bundle SS may be formed with only the first sheet S1 and the third sheet S3 and without the second sheet S2.

Next, an aligning procedure of respective sheets S of the sheet bundle SS in the sheet conveyance direction D using the end stopper 62*a* inside the processing unit 22 will be described.

The standby unit 21 controls a rotation amount of the outlet roller 33*a* and the discharge roller 44*a* to control a position of the sheet S in the standby unit 21. The sheet conveyance device, including the outlet roller 33*a* and the discharge roller 44*a*, conveys the first sheet S1 and the third sheet S3 to a first position in the downstream side of the sheet placing position SP on the standby tray 41. The sheet conveyance device conveys the second sheet S2 to a second position upstream of the first sheet S1 and the third sheet S3. The sheet bundle SS is formed by shifting the second sheet S2 (intermediate-paper sheet) upstream in the sheet conveyance direction D of the first sheet S1 and the third sheet S3 (cover and back cover sheets).

When the sheet bundle SS is pressed against the end stopper 62*a* inside the processing unit 22, the driving member such as a roller and a paddle (not illustrated) comes in contact with the first sheet S1 and the third sheet S3. The first sheet S1 and the third sheet S3 are moved to the end stopper 62*a* while contacting the driving member with a relatively strong friction force. The second sheets S2 are moved to the end stopper 62*a* while the sheets contact with each other with a relatively weak friction force. When the upstream end portion (end SSa) of the sheet bundle SS abuts the end stopper 62*a*, the second sheet S2 abuts the end stopper 62*a* earlier than the first sheet S1 and the third sheet S3, and the second sheet S2 slides in the downstream side. Thereafter, all the sheets S abut the end stopper 62*a* such that the respective sheets S of the sheet bundle SS are aligned in the sheet conveyance direction D.

The standby unit 21 includes the end chuck 90 (see FIG. 3) that moves towards or away the standby tray 41. The end chuck 90 can press the end portion Sa of the sheet S so that the sheet S does not move. The end chuck 90 and the upper surface 45*b* of the end portion of the standby tray 41 constitute an upstream-side holding unit that holds the sheet S by pinching the upstream end portion of the sheet between the end chuck 90 and the upper surface 45*b*. When the sheet conveyance device conveys the second and succeeding sheets S to the standby unit 21, the end chuck 90 presses the end portion Sa of the previously placed sheet S. The end chuck 90 allows conveying of the next sheet S into the standby unit 21 at both of a holding position where the end chuck 90 holds the upstream end portion of the sheet S and a releasing position where the end chuck 90 releases the upstream end portion of the sheet S.

The discharge roller 44*a* can move towards or away from the standby tray 41, and can press the downstream side of the sheet S so that the sheet S does not move. The discharge roller 44*a* and the discharge roller 44*b* supported in the tip portion of the standby tray 41 constitute a downstream-side holding unit that holds the sheet S by pinching the downstream end portion of the sheet S between the discharge rollers 44*a* and 44*b*. The discharge roller 44*a* is moved between the holding position where the discharge roller 44*a* holds the downstream side of the sheet S and the releasing position where the discharge roller 44*a* releases the holding of the downstream side and the upstream side of the sheet S. The discharge roller 44*a* can be driven in reverse while holding the sheet S so as to feed the sheet S backward. The "back-feeding" conveys the sheet S in a direction opposite to the sheet conveyance direction D.

The sheet S conveyed on the standby tray 41 is held by the discharge roller 44*a* and then, returned to a specified position by reverse driving of the discharge roller 44*a*. In this case, the end chuck 90 is moved to the releasing position so that the upstream end portion of the returned sheet S can be received in a pinching position of the end chuck 90.

When the second sheet S2 is shifted to the upstream side in the sheet conveyance direction D relative to the first sheet S1 and the third sheet S3, an amount of return by the discharge roller 44*a* can be changed according to the sheet S.

For example, an outlet sensor 33*c* detecting the downstream end portion of the sheet S is provided near the outlet roller 33*a*. After the outlet sensor 33*c* detects the downstream end portion of the sheet S, the post-processing control unit 24 controls respective driving motors (not illustrated) of the outlet roller 33*a* and the discharge roller 44*a* with control signals. Accordingly, the conveyance position of the sheet S on the standby tray 41 can be controlled and the sheet S can be conveyed to the specified position on the standby tray 41.

Thus, stacking of the second sheet S2 to be shifted to the upstream side in the sheet conveyance direction D with respect to the first sheet S1 and the third sheet S3 can be performed easily and securely.

Next, a procedure by the standby unit 21 for shifting respective sheets S of the sheet bundle SS in a step shape in order to bind the sheet bundle SS with a tape by the tape binding unit 62 of the processing unit 22 will be described.

The standby unit 21 can control positions of respective sheets S of the sheet bundle SS by controlling the sheet conveyance device including the outlet roller 33*a* and the discharge roller 44*a*. The standby unit 21 can sequentially change the displacement of the plurality of sheets S placed on the standby tray 41 so as to stack and align the plurality of sheets S in the step shape with the sheets shifted S by a specified amount in the sheet conveyance direction D.

The tape binding unit 62 is provided at the upstream end portion of the processing tray 61. The tape binding unit 62 performs sheet binding processing on the upstream end portion (one end SSa) of the sheet bundle SS conveyed on the processing tray 61 with an adhesive tape. In this case, the upstream end portion of the sheet bundle SS is formed with the respective sheets S of the sheet bundle SS in the step shape, and the tape adheres easily to a surface of the second sheet S2 (an intermediate-paper sheet). Accordingly, a binding strength of the intermediate sheet is greater than when the tape is only adhered to an end of the second sheet S2.

The conveying rollers 63*a* and 63*b* are positioned with a predetermined gap in the sheet conveyance direction D. The conveying belt 64 is stretched between the conveying rollers 63*a* and 63*b*. The conveying belt 64 is rotated synchronously with the conveying rollers 63*a* and 63*b*. The conveying belt 64 conveys the sheet S between the tape binding unit 62 and the discharging unit 23.

A process for pressing down the sheet S in the standby unit 21 will be described.

The post-processing device 3 may be configured in such a way that the end portion Sa of the sheet S is pressed down so as not to allow the sheet S to float up in the standby unit 21.

As illustrated in FIG. 3, the post-processing device 3 includes the end chuck 90 as a member pressing down the end portion Sa of the sheet S in the standby unit 21.

Figure 8:
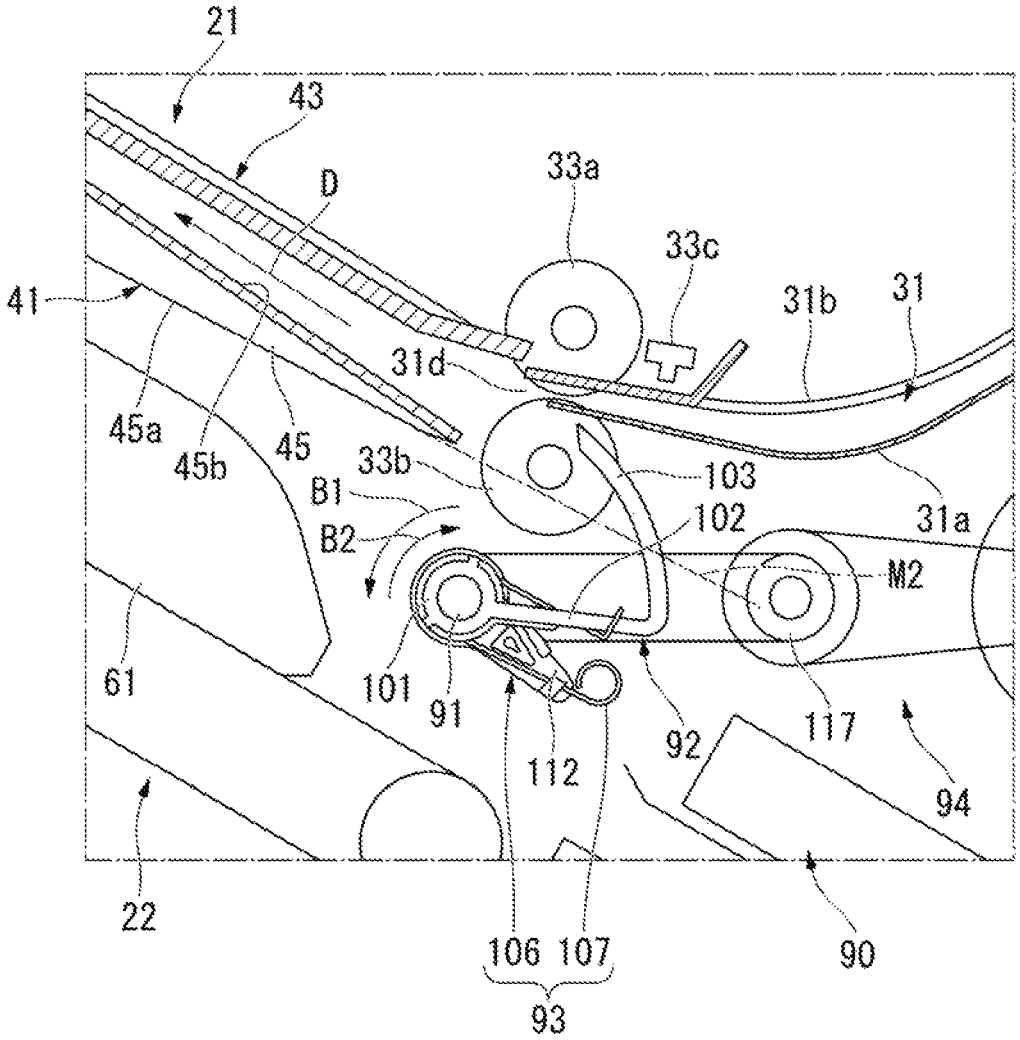
FIG. 8 is a detailed sectional view illustrating a periphery of the pressing member.
Figure 9:
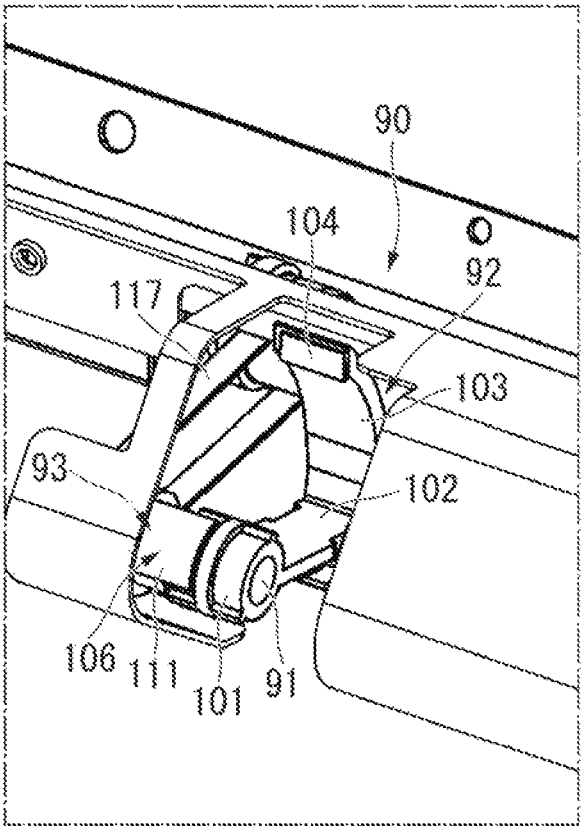
FIG. 9 is a detailed perspective view illustrating the periphery of the pressing member.
Figure 10:
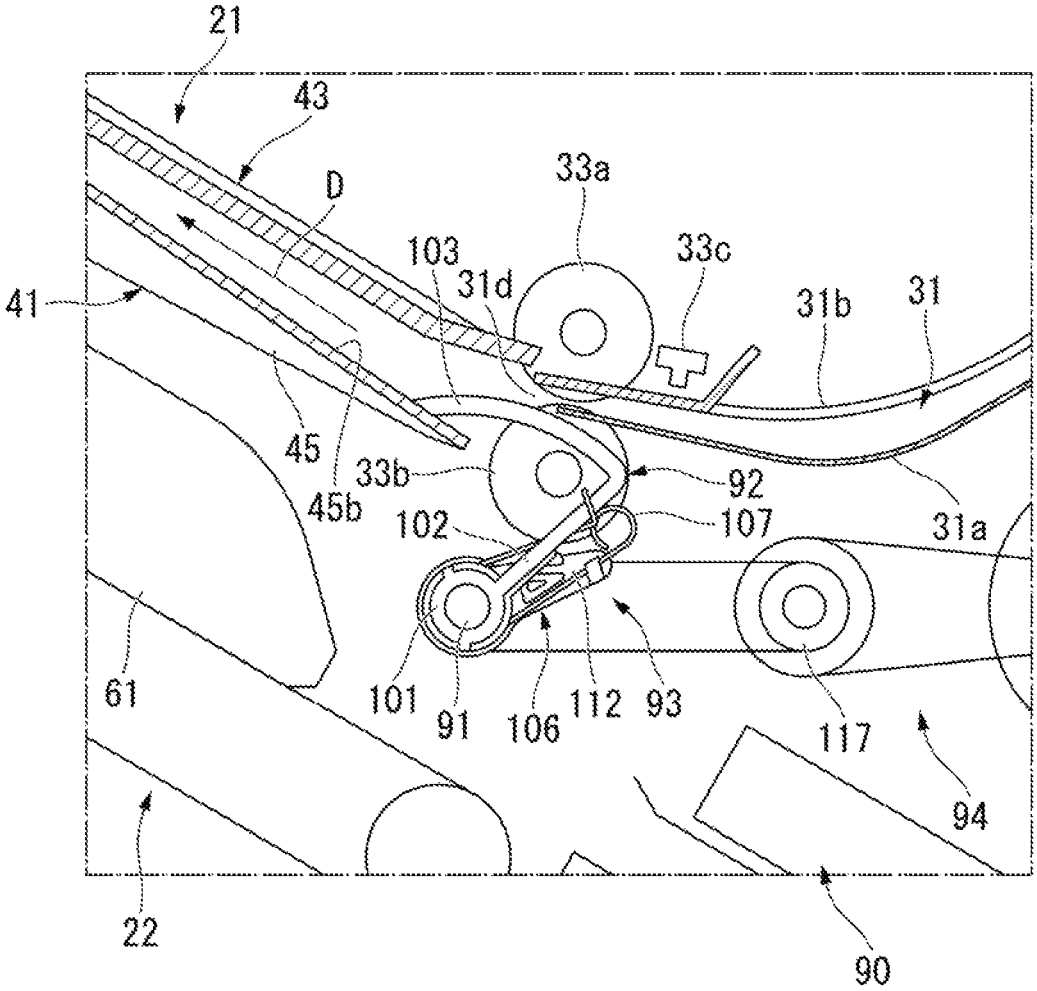
FIG. 10 is a detailed sectional view illustrating the periphery of the pressing member during an example operation.

FIGS. 8 to 10 illustrate the end chuck 90 on an enlarged scale. As illustrated in FIG. 8, the end chuck 90 includes a rotating shaft 91, a plurality of pressing members 92, a plurality of pressurizing portions 93, and the driving unit 94.

The rotating shaft 91 is a rotation center of the pressing member 92. The rotating shaft 91 extends in the sheet width direction W. The pressing member 92 is rotatable around the rotating shaft 91 in an arrow direction B1 and an arrow direction B2 in FIG. 8. The rotating shaft 91 is positioned below the standby unit 21 (for example, below the standby tray 41). The rotating shaft 91 is also positioned between the standby tray 41 and the processing tray 61. For example, the rotating shaft 91 may be positioned below an extension line M2 extending from the lower surface 45*a* of the standby tray 41. For example, the rotating shaft 91 may be coaxially provided with the rotation shaft 49 of the paddle unit 34.

The pressing member 92 includes a first cylindrical unit 101, a radial arm 102, and a pressing arm 103.

The first cylindrical unit 101 is rotatably attached to the rotating shaft 91. The first cylindrical unit 101 and the rotating shaft 91 are positioned below the end portion of the standby tray 41.

The radial arm 102 is attached to the first cylindrical unit 101. The radial arm 102 can rotate around the rotating shaft 91 integrally with the first cylindrical unit 101. The radial arm 102 extends from the first cylindrical unit 101 outwardly in the radial direction. The radial arm 102 can rotate to be closer to the upstream side of the standby tray 41 than the first cylindrical unit 101 in the sheet conveyance direction D.

The pressing arm 103 extends from an extended tip of the radial arm 102 to the standby unit 21 side. The pressing arm 103 extends from the extended tip of the radial arm 102 toward the downstream side in the sheet conveyance direction D. For example, the pressing arm 103 may be formed in a circular arc shape around the rotating shaft 91. The pressing arm 103 can rotate around the rotating shaft 91 integrally with the radial arm 102. The pressing arm 103 rotates toward the standby tray 41 so as to press the end portion Sa of the sheet S toward the upper surface 45*b* of the standby tray 41.

As illustrated in FIG. 9, a friction member 104 is provided on the tip portion of the pressing arm 103. For example, the friction member 104 may be formed of a material having relative low hardness and a relative high coefficient of friction. For example, the friction member 104 may be formed of a rubber material such as ethylene propylene diene rubber (EPDM).

FIG. 10 illustrates the pressing member 92 rotated to a position where the pressing member 92 contacts the upper surface 45*b* of the standby tray 41. As illustrated in FIG. 8 and FIG. 10, the pressing member 92 is movable between a retreating position (see FIG. 8) and a pressing position (see FIG. 10). That is, the pressing member 92 rotates between the retreating position and the pressing position, around the rotating shaft 91.

In the retreating position, the pressing arm 103 is positioned upstream of the standby tray 41 in the sheet conveyance direction D. In the retreating position, the pressing arm 103 is also positioned upstream of the sheet discharge port 31*d* in the sheet conveyance direction D. Further, in the retreating position, the pressing arm 103 is positioned upstream of the rotating shaft 91 in the sheet conveyance direction D.

In the pressing position, the pressing arm 103 faces the upper surface 45*b* of the standby tray 41 from above. When the sheet S is received in the standby tray 41, the tip portion (for example, the friction member 104) of the pressing arm 103 contacts the end portion Sa of the sheet S. The pressing arm 103 presses down the end portion Sa of the sheet S toward the upper surface 45*b* of the standby tray 41.

The pressing member 92 is separated from the conveyance passage 31 at both the retreating position and the pressing position. The pressing member 92 allows the sheet S move from the conveyance passage 31 to the standby unit 21 even when the pressing member 92 is positioned at either the retreating position or the pressing position. That is, when the pressing member 92 is positioned at the retreating position, the sheet S passes above a gap between the tip portion of the first guide member 31*a* and the standby tray 41 and is conveyed to the standby unit 21.

When the pressing member 92 is positioned at the pressing position, the pressing arm 103 extends in a circular arc shape from below the tip portion of the first guide member 31*a* toward the upper surface 45*b* of the standby tray 41. In this case, the pressing member 92 is provided between the tip portion of the first guide member 31*a* and the standby tray 41 without protruding into the sheet discharge port 31*d*. A sheet S passes above the pressing member 92 and is conveyed to the standby unit 21.

As illustrated in FIG. 7, plural pressing members 92 are separated from each other in the sheet width direction W. Each pressing member 92 also has a pressurizing portion 93 operatively connected thereto.

As illustrated in FIG. 8, each pressurizing portion 93 includes a pressurizing member 106 and a spring 107.

The pressurizing member 106 includes a second cylindrical unit 111 (see FIG. 9) and a supporting unit 112 (see FIG. 8).

As illustrated in FIG. 9, the second cylindrical unit 111 is attached to the rotating shaft 91 near the first cylindrical unit 101. For example, the second cylindrical unit 111 may be fixed to the rotating shaft 91. The second cylindrical unit 111 rotates integrally with the rotating shaft 91.

As illustrated in FIG. 8, the supporting unit 112 protrudes from the second cylindrical unit 111 in the radial direction of the rotating shaft 91. The supporting unit 112 is integrally formed with the second cylindrical unit 111. The supporting unit 112 is positioned on the radial arm 102 displaced circumferentially with respect to the pressing member 92 in the direction of arrow B2.

The spring 107 is provided between the supporting unit 112 of the pressurizing member 106 and the radial arm 102 of the pressing member 92. When a distance between the supporting unit 112 of the pressurizing member 106 and the radial arm 102 of the pressing member 92 is shorter than a predetermined distance, the spring 107 urges the radial arm 102 of the pressing member 92 in a direction in which the radial arm 102 separates from the supporting unit 112 of the pressurizing member 106.

Next, the driving unit 94 will be described.

The driving unit 94 includes a driving source 116 (see FIG. 3) and a power transmission mechanism 117. For example, the driving source 116 may be a pulse motor. The power transmission mechanism 117 includes a pulley attached to a driving shaft of the driving source 116, a pulley attached to the rotating shaft 91, and a belt for interlocking the pulleys. With this arrangement, the driving source 116 rotates the rotating shaft 91 through the power transmission mechanism 117.

The driving source 116 rotates the rotating shaft 91 so as to rotate the pressurizing member 106 in the arrow direction B1 and the arrow direction B2 in FIG. 8.

When the driving unit 94 rotates the pressurizing member 106 in the arrow direction B1, the supporting unit 112 of the pressurizing member 106 is rotated in the arrow direction B1. When the supporting unit 112 of the pressurizing member 106 is rotated in the arrow direction B1, the pressing member 92 is rotated in the arrow direction B1 by the spring 107. Accordingly, the pressing member 92 is moved from the retreating position to the pressing position.

When the pressing arm 103 rotates and then contacts the sheet S held in the standby tray 41, the pressing member 92 is stopped. However, even after the pressing member 92 stops rotating, the driving unit 94 continues to rotate the supporting unit 112 of the pressurizing member 106 in the arrow direction B1. For that reason, the spring 107 is tightened between the supporting unit 112 of the pressurizing member 106 and the radial arm 102 of the pressing member 92. Accordingly, the spring 107 urges the pressing member 92 toward the upper surface 45*b* of the standby tray 41. That is, the pressing arm 103 of the pressing member 92 presses against the end portion Sa of the sheet S.

When the driving unit 94 rotates the pressurizing member 106 in the arrow direction B2, the supporting unit 112 of the pressurizing member 106 is rotated in the arrow direction B2. When the supporting unit 112 of the pressurizing member 106 is rotated in the arrow direction B2, the pressing member 92 is rotated by the spring 107 in the arrow direction B2. Accordingly, the pressing member 92 is returned from the pressing position to the retreating position.

Next, the assist guide 43 will be described.

The assist guide 43 functions to press the end portion Sa of the sheet S in the standby unit 21.

Figure 11:
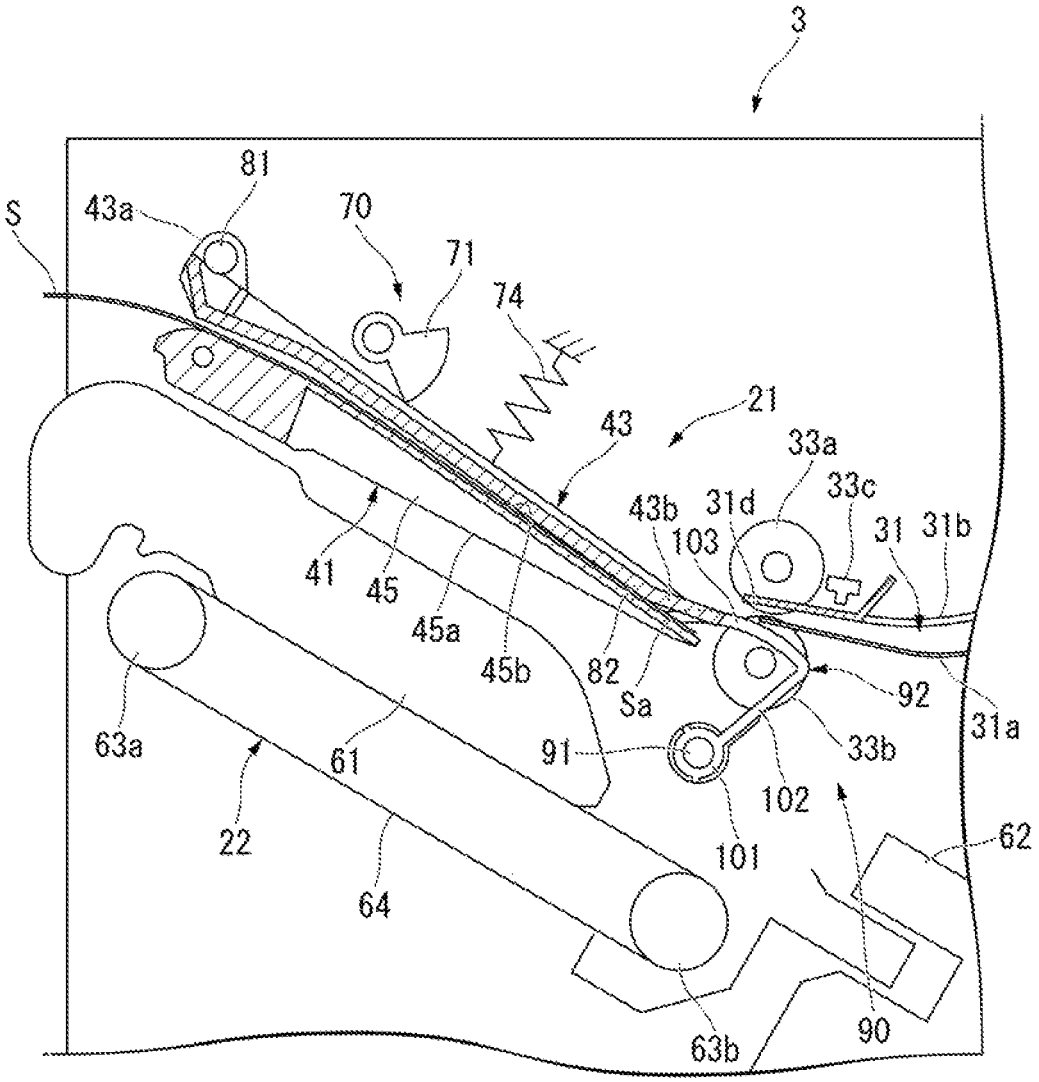
FIG. 11 is a sectional view illustrating the standby unit and the processing unit with a second operation example.

FIG. 11 illustrates the assist guide 43 positioned so that the assist guide 43 presses the sheet S. As illustrated in FIG. 11, the assist guide 43 is movable to the pressing position that is down from the standby position less than the protruding position. The assist guide is also movable to the standby position and the protruding position. The assist guide 43 presses the sheet S downward when positioned at the pressing position. The assist guide 43 is rotated to the pressing position by the driving mechanism 70 as described above.

In the pressing position, the pushing portion 82 of the assist guide 43 presses the end portion Sa of the sheet S toward the upper surface 45*b* of the standby tray 41. The end chuck 90 and the assist guide 43 press the end portion Sa of the sheet S toward the upper surface 45*b* of the standby tray 41 in the standby unit 21.

As illustrated in FIG. 7, a width of the assist guide 43 in the sheet width direction W is greater than a width of the sheet S in the sheet width direction W. For example, the assist guide 43 has such a width as to accommodate the end portion Sa of the sheet S of plural types of specifications (for example, a postcard size, B5 size, and A4 size). The width of the assist guide 43 in the sheet width direction W is greater than a width of the pressing member 92 (that is, a total width of the plurality of pressing members 92) in the sheet width direction W.

The assist guide 43 and the end chuck 90 are each respectively formed in a comb shape. The assist guide 43 includes a plurality of cutout portions 83. The plurality of cutout portions 83 are provided at positions corresponding to the plurality of pressing units 103. Each cutout portion 83 is located on the rear end of the assist guide 43 in the sheet conveyance direction D. The plurality of pressing units 103 respectively fit in the plurality of cutout portions 83. The plurality of pressing units 103 can be respectively moved through the plurality of cutout portions 83 to press the end portion Sa of the sheet S without interfering with the assist guide 43. For example, the plurality of pressing units 103 can press the end portion Sa of the sheet S while the assist guide 43 presses the end portion Sa of the sheet S.

Next, description will be made with respect to processing performed by the post-processing control unit 24 when the sheet bundle SS is formed on the standby tray 41.

FIGS. 12A through 15C illustrate operations for making a the sheet bundle SS in the standby tray 41.

Figure 12A:
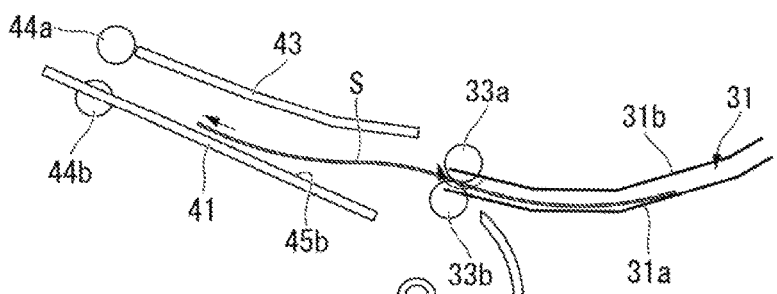
FIGS. 12A to 12D are diagrams illustrating operations of the post-processing device in order from FIG. 12A to FIG. 12D.

FIG. 12A illustrates a state where a first sheet S enters the standby tray 41 from the conveyance passage 31. The post-processing control unit 24 positions the assist guide 43 at the standby position when the sheet S is conveyed from the conveyance passage 31 to the standby tray 41. That is, the post-processing control unit 24 controls the assist guide 43 to be at a position above the sheet discharge port 31*d* of the conveyance passage 31. For that reason, the sheet S conveyed from the conveyance passage 31 can enter into the standby tray 41 without being obstructed by the assist guide 43.

In this state, the post-processing control unit 24 also positions the pressing member 92 and the discharge roller 44*a* at the respective retreating positions. The post-processing control unit 24 drives and controls the outlet roller 33*a* and advances the sheet S until a portion (downstream side) of the sheet S passes the sheet placing position SP (see FIG. 5) of the standby tray 41. This process is referred to as the "sheet conveying process ST1".

Figure 12B:
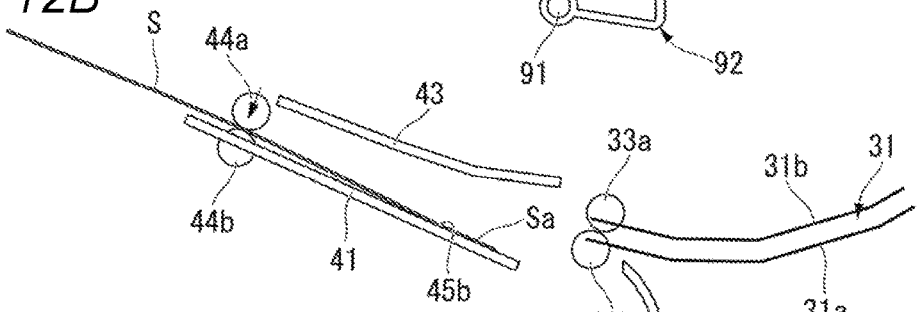

FIG. 12B illustrates a state where the discharge roller 44*a* is moved from the releasing position to the holding position and holds the sheet S. The discharge roller 44*a* is moved towards the sheet S and the discharge roller 44*b*. The sheet S is held in the nip formed between the discharge roller 44*a* and 44*b*. This process is referred to as the "downstream-side holding process ST2". The downstream-side holding unit may have a configuration in which a holding member different from a sheet conveyance member such as the discharge rollers 44*a* and 44*b* is provided. In other words, the downstream-side holding unit is not limited to the configuration in which the sheet S is pinched between the discharge roller 44*a* and 44*b*.

Figure 12C:
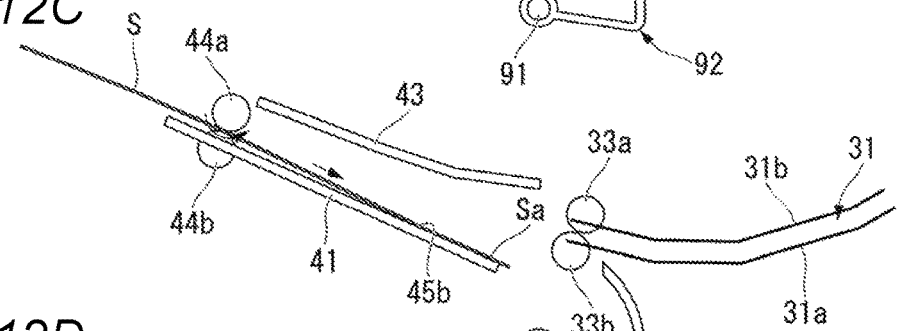

FIG. 12C illustrates a state where the discharge roller 44*a* is reverse driven while holding the sheet S so as to return the sheet S to the upstream side of the standby tray 41. Thus, the sheet S held by the discharge roller 44*a* is fed back to the sheet placing position SP of the standby tray 41. This process is referred to as the "sheet returning process ST3". The sheet S is longer than the standby tray 41 in the sheet conveyance direction. Thus, the sheet S can be shifted with respect to the sheet placing position SP along the entire length of the standby tray 41 in the sheet conveyance direction D.

Figure 12D:
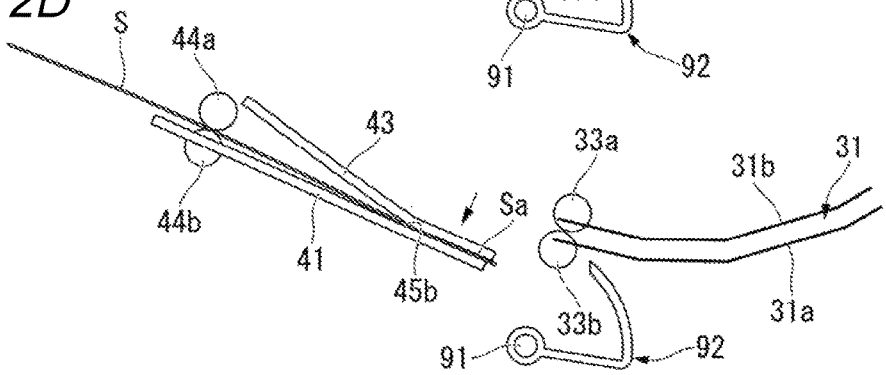

FIG. 12D illustrates a state where the upstream side of the sheet S at the sheet placing position SP is pressed to the standby tray 41 side by the assist guide 43. The post-processing control unit 24 rotates the assist guide 43 to the pressing position by the driving mechanism 70 after returning the sheet S to the specified position. The assist guide 43 is rotated to the pressing position so that the end portion Sa of the sheet S is pressed toward the upper surface 45*b* of the standby tray 41. Pressing of the sheet S by the assist guide 43 is conducted before the pressing member 92 presses the sheet S. The assist guide 43 is rotated by the driving mechanism 70 so that the end portion Sa of the sheet S is pressed by a force larger than the weight of the assist guide 43. The assist guide 43 presses the end portion Sa of the sheet S to be stretched flat. For example, if when the end portion Sa of the sheet S is curled, the curling is stretched flat. Thus, curling up of the upstream side of the sheet S from the standby tray 41 is prevented. This process is referred to as the "sheet assistance process ST4". In this process, the sheet S is pressed by an assistance member (assist guide 43) different from the upstream-side holding unit (pressing member 92) and the downstream-side holding unit (discharge roller 44*a*).

Figure 13A:
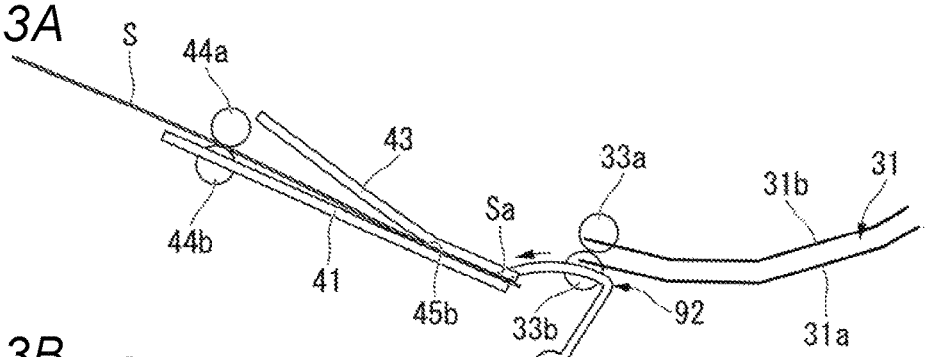
FIGS. 13A to 13D illustrate operations of the post-processing device in order from FIG. 13A to FIG. 13D.

FIG. 13A illustrates a state where the pressing member 92 is moved to press the sheet S after the assist guide 43 presses the sheet S. The pressing member 92 is rotated to the pressing position by the driving unit 94 and the pressurizing portion 93. The pressing member 92 is rotated to the pressing position so as to press the end portion Sa of the sheet S toward the upper surface 45*b* of the standby tray 41. This process is referred to as the "upstream-side holding process ST5". The pressing member 92 presses the end portion Sa of the sheet S in a state where the assist guide 43 presses the end portion Sa of the sheet S.

Figure 13B:
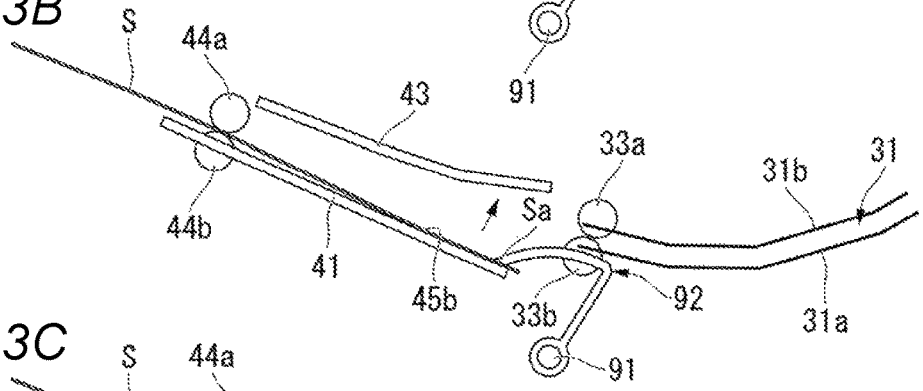

FIG. 13B illustrates a state where the assist guide 43 is returned to the standby position. The assist guide 43 is separated from the sheet Sand returned to the standby position after the pressing member 92 presses the end portion Sa of the sheet S. The assist guide 43 is moved upward above the sheet discharge port 31*d* of the conveyance passage 31 before the next sheet S is conveyed from the conveyance passage 31 to the standby tray 41. This process is referred to as the "assistance release process ST6". The next sheet S can be conveyed to the standby tray 41 while the pressing member 92 is positioned in the pressing position.

Figure 13C:
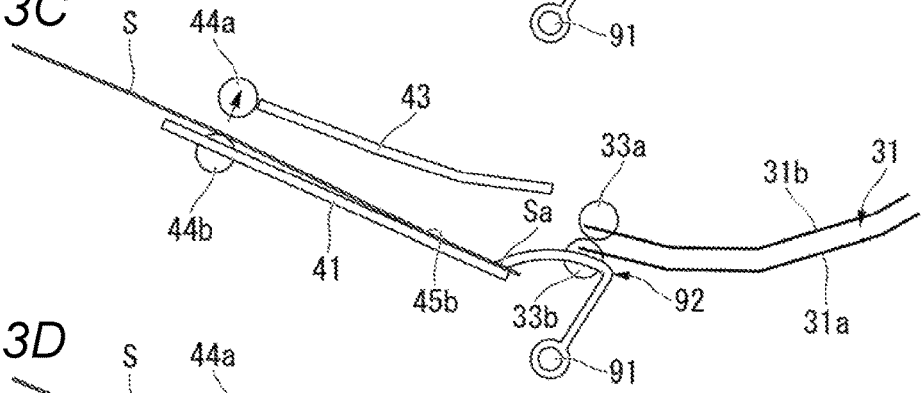

FIG. 13C illustrates a state where the discharge roller 44*a* is moved from the holding position to the releasing position and the downstream side of the sheet S is released. This process is referred to as the "downstream-side release process ST7". The downstream-side release process ST7 is ended before the next sheet S (second and succeeding sheets S) is conveyed to the standby unit 21.

Figure 13D:
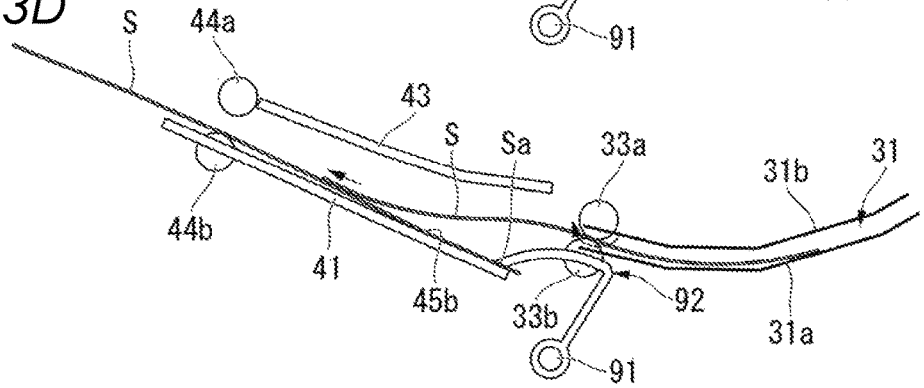

FIG. 13D illustrates a state where the next sheet S (second and succeeding sheets S) is conveyed to the standby tray 41 from the conveyance passage 31. That is, the sheet conveying process ST1 is performed on the next sheet S. During the sheet conveying process ST1 for the next sheet S, the rear end portion Sa of the previous sheet S, which is already on the standby tray 41, is held by the pressing member 92. For that reason, the previous sheet S on the standby tray 41 does not moved even though the previous sheet is subject to a friction force when the next sheet S is conveyed onto the standby tray 41. The next sheet S is guided to the upper surface of the pressing member 92 to be held on the standby tray 41. Thus, the next sheet S is stacked on the previous sheet S, on the standby tray 41.

Figure 14A:
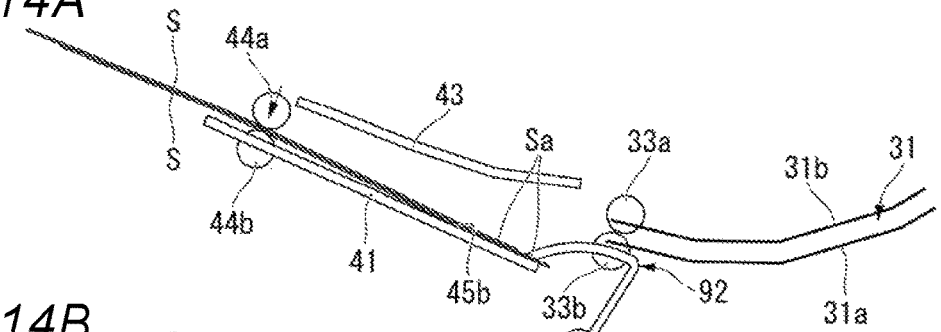
FIGS. 14A to 14D illustrate operations of the post-processing device in order from FIG. 14A to FIG. 14D.

FIG. 14A illustrates a state in which the discharge roller 44*a* are moved from the releasing position to the holding position again to hold the next sheet S and the previous sheet S. That is, the downstream-side holding process ST2 is performed on the next sheet S.

Figure 14B:
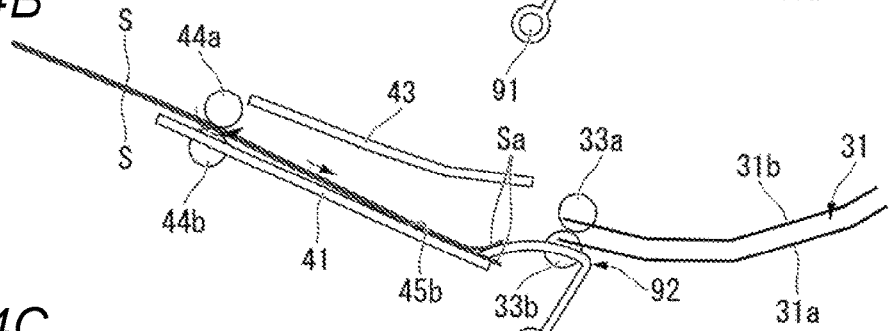

FIG. 14B illustrates a state where the discharge roller 44*a* is reverse driven to return the sheet S to the upstream side after the downstream-side holding process ST2 is conducted on the next sheet S. That is, the sheet returning process ST3 is performed on the next sheet S. In this case, the next sheet S is returned to an offset position shifted closer to either the upstream side or the downstream side than the previous sheet S on the standby tray 41 by a specified amount. In this case, the pressing member 92 is positioned at the holding position and thus the end portion Sa of the next sheet S runs onto the tip portion of the pressing member 92.

Figure 14C:
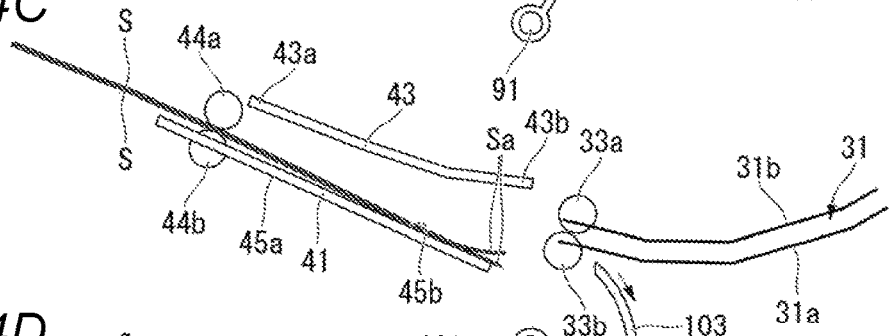

FIG. 14C illustrates a state where the pressing member 92 is moved from the holding position to the releasing position and the upstream side of the sheet S is released after the sheet returning process ST3 for the next sheet S. This process is referred to as the "upstream-side release process ST8". In this case, the downstream side of each sheet S is held by the discharge roller 44*a* and thus movement on the standby tray 41 is prevented. The pressing member 92 is moved to the releasing position so that the next sheet S does not run onto the pressing member 92.

Figure 14D:
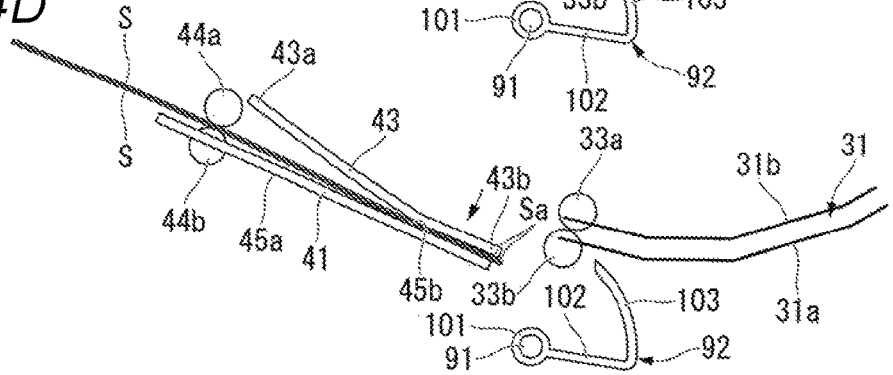

FIG. 14D illustrates a state where the assist guide 43 is rotated to the pressing position after the upstream-side release process ST8. That is, the sheet assistance process ST4 is conducted on the next sheet S and the end portion Sa of the sheet S is stretched flat. If the sheet assistance process ST4 is performed while the end portion Sa of the sheet S runs onto the pressing member 92, a shearing force could be applied to or wrinkles could be generated in the end portion Sa of the sheet S.

Figure 15A:
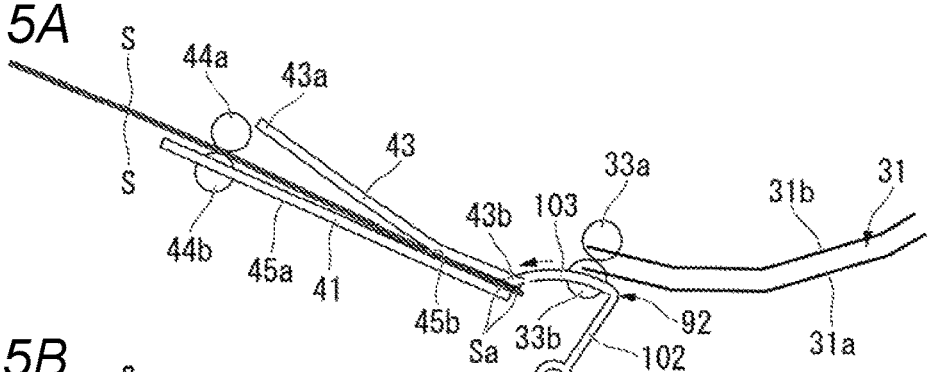
FIGS. 15A to 15C illustrate operations of the post-processing device in order from FIG. 15A to FIG. 15C.

FIG. 15A illustrates a state where the pressing member 92 presses the next sheet S and the previous sheet S after the sheet assistance process ST4 is performed with respect to the next sheet S. That is, the upstream-side holding process ST5 is conducted on the next sheet S. After the assist guide 43 presses the end portion Sa of the next sheet S, the pressing member 92 is rotated to the pressing position again. The pressing member 92 is rotated to the pressing the pressing position and presses the end portion Sa of the next sheet S toward the upper surface 45*b* of the standby tray 41. The pressing member 92 presses the end portion Sa from the same side as the assist guide 43 with respect to the next sheet S. In this case, the end portion Sa of the sheet S extends in a flat shape and thus generation of a shearing force or wrinkles in the end portion Sa of the sheet S is prevented.

Figure 15B:
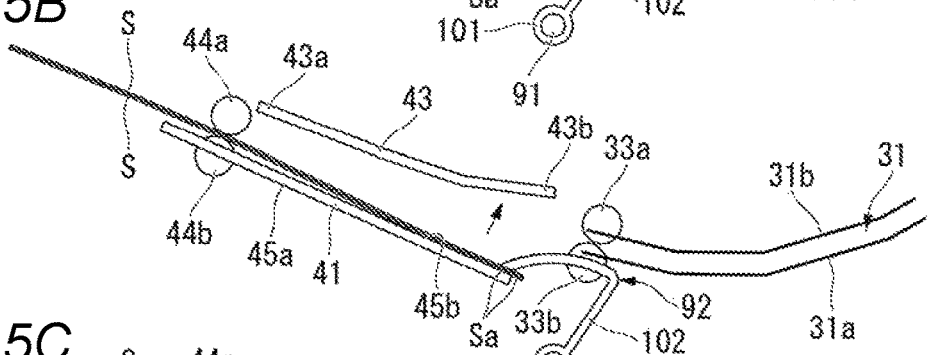

FIG. 15B illustrates a state where the assist guide 43 is returned to the standby position again. The assist guide 43 is separated from the next sheet S after the pressing member 92 presses the end portion Sa of the next sheet S. That is, the assistance release process ST6 is conducted on the next sheet S.

Figure 15C:
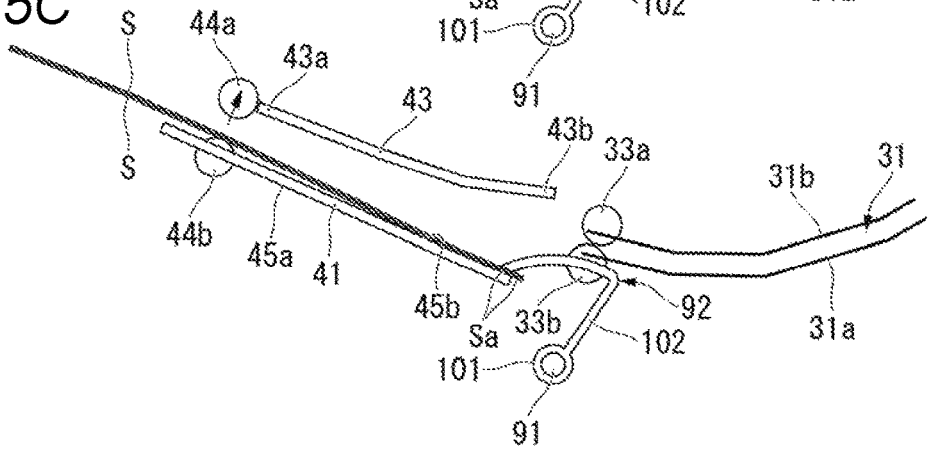

FIG. 15C illustrates a state where the discharge roller 44*a* is moved from the holding position to the releasing position again and holding of the next sheet S is released. That is, the downstream-side release process ST7 is conducted on the next sheet S.

Hereinafter, the processes from FIG. 13D to FIG. 15C are repeated according to the number of sheets S. With this, the sheet bundle SS obtained by stacking a plurality of sheets is formed on the standby tray 41. The way that respective sheets S of the sheet bundle SS are shifted and stacked offset with each other is determined through control of the amount of return of the sheet S in the sheet returning process ST3 described above. That is, the sheet bundle SS may be formed different ways, such as: a state where a plurality of sheets S are aligned, a state where an intermediate-paper sheet is shifted to the upstream side with respect to the cover sheet or the back cover sheet, a state where one end SSa of the sheet bundle SS is shifted in a step shape, or the like can be formed by a common device configuration. When one end SSa of the sheet bundle SS is shifted in a step shape, the next sheet S may shifted to the upstream side or the downstream side with respect to the previous sheet S.

According to the post-processing device 3 according to the embodiment, a sheet aligning mechanism and a sheet shifting mechanism can be achieved. The sheet aligning mechanism aligns a plurality of sheets S by back-feeding on the standby tray 41 to align the upstream end portion of the sheet bundle SS. The sheet shifting mechanism shifts a plurality of sheets S little by little on the standby tray 41 to form the upstream end portion of the sheet bundle SS in a suitable step shape. For that reason, a device configuration and process shifting one end SSa of the sheet bundle SS in a step shape can be achieved without complication.

According to the post-processing device 3 according to the embodiment, the upstream-side holding unit includes an upstream side pressing member (corresponding to pressing member 92) which presses the sheet S to the standby tray 41 side to be held. For that reason, curling up of the sheet S on the standby tray 41 can be prevented, the sheet S can be held with higher accuracy, and the sheet S can be evenly shifted.

The upstream side pressing member switches between the holding position and the releasing position. In the holding position, the upstream side pressing member holds the sheet S by pinching the sheet S between the upstream side pressing member and the upper surface 45*b* of the standby tray 41 side. In the releasing position, the upstream side pressing member is separated from the standby tray 41 to release the holding of the sheet S. For that reason, the standby tray 41 can be used to effectively hold the sheet S.

The upstream side pressing member allows the next sheet S to be conveyed to the standby unit 21 at both the holding position and the releasing position. For that reason, a number of times of the upstream side pressing member between the holding position and the releasing position accompanied by the conveyance of the sheet S can be reduced.

According to the post-processing device 3 according to the embodiment, the downstream-side holding unit includes a downstream side pressing member (corresponding to discharge roller 44*a*). The downstream side pressing member presses the sheet S to the standby tray 41 side to be held. For that reason, curling up of the sheet S on the standby tray 41 can be can be held with higher accuracy, and the sheet S can be evenly shifted.

The downstream side pressing member switches between the holding position and the releasing position. In the holding position, the downstream side pressing member approaches the standby tray 41 and holds the sheet S by pinching the sheet S between the downstream side pressing member and the supporting unit (corresponding to discharge roller 44*b*) of the standby tray 41 side. In the releasing position, the downstream side pressing member is separated from the standby tray 41 to release the holding of the sheet S. For that reason, the standby tray 41 can be used to effectively hold the sheet S.

The downstream side pressing member is a rotating roller capable of being reverse driven for returning the held sheet S to the upstream side in the sheet conveyance direction D. For that reason, the rotating roller can be used to allow the sheet S to be held and released and can easily perform back-feeding of the sheet S.

According to the post-processing device 3 according to the embodiment, an assistance member for suppressing the sheet S to the standby tray 41 side is further provided. For that reason, curling up of the sheet S on the standby tray 41 can be restrained, the sheet S can be held with higher accuracy, and the sheet S can be evenly shifted.

The processing unit 22 includes the tape binding unit 62 for binding the sheet bundle SS with tape. For that reason, processing for shifting one end SSa of the sheet bundle SS in a step shape can be effectively achieved in the post-processing for performing tape binding with no damage binding processing.

The following sheet processing method is also included in the embodiment.

That is, the sheet processing method may include the sheet conveying process ST1, the downstream-side holding process ST2, the sheet returning process ST3, the upstream-side holding process ST5, the downstream-side release process ST7, and the upstream-side release process ST8. In the sheet conveying process ST1, the sheet S is conveyed to the standby unit 21 and the sheet S is advanced to the downstream side in the sheet conveyance direction D until the sheet S passes the sheet placing position SP on the standby tray 41. In the downstream-side holding process ST2, the sheet S passing the sheet placing position SP in the sheet conveying process ST1 is held in the downstream side of the standby tray 41. In the sheet returning process ST3, the sheet S held in the downstream-side holding process ST2 is returned to the sheet placing position SP. In the upstream-side holding process ST5, the sheet S returned to the sheet placing position SP in the sheet returning process ST3 is held in the upstream side of the standby tray 41. In the downstream-side release process ST7, the previous sheet S in the downstream side of the standby tray 41 is released before the sheet conveying process ST1 for the next sheet S of second and succeeding sheets. In the upstream-side release process ST8, the previous sheet S in the upstream side of the standby tray 41 is released after the downstream-side holding process ST2 for the next sheet S. In the sheet returning process ST3 for the next sheet S after the upstream-side release process ST8, the next sheet S is returned to a position shifted to be closer to the upstream side or the downstream side than the previous sheet S in the sheet placing position SP so that one end SSa of the sheet bundle SS has a step shape.

Thus, although description is made with respect to a configuration of one embodiment, the configuration of the sheet processing device is not limited to the example described above. For example, the sheet processing device may be an image forming apparatus including a finisher inside a drum in a casing.

In the embodiment, the end chuck 90 and the discharge roller 44*a* (upstream-side holding unit and downstream-side holding unit) press the sheet S toward the upper surface 45*b* of the standby tray 41. However, the sheet support surface on which the sheet S is pressed by the upstream-side holding unit and the downstream-side holding unit is not limited to the upper surface 45*b* of the standby tray 41. For example, at least one of the upstream-side holding unit and the downstream-side holding unit may be provided separate from a member forming the sheet support surface.

In the embodiment, the assist guide 43 presses the upstream side of the sheet S. However, an assist guide pressing the downstream side of the sheet S may be included. That is, an assist guide pressing at least one of the upstream side and the downstream side of the sheet S may be included. Also, a configuration in which the assist guide is not included may be adopted.

In the embodiment, the processing unit 22 includes the tape binding unit 62. However, the processing unit 22 may include, for example, a stapling unit instead of the tape binding unit 62.

In the embodiment, the outlet sensor 33*c* of the conveyance unit detects a position of the sheet S conveyed to the standby unit 21. However, a sensor disposed in the standby unit 21 may also be provided without being limited to the outlet sensor 33*c* of the conveyance unit. For example, a line sensor directly detecting one end SSa of the sheet bundle SS may also be provided.

According to at least one embodiment described above, the post-processing device 3 includes the standby unit 21, the processing unit 22, the upstream-side holding unit (e.g., pressing member 92), the downstream-side holding unit (e.g., discharge roller 44*a*), the sheet position detecting unit (e.g., outlet sensor 33*c*), and the control unit 24. The standby unit 21 includes the standby tray 41 in which a plurality of previous sheets S are stacked before being subjected to processing on the standby tray 41 to form the sheet bundle SS. The processing unit 22 performs specified processing on the sheet bundle SS conveyed from the standby unit 21. The upstream-side holding unit is arranged at the upstream side of the standby tray 41 in the sheet conveyance direction D. The upstream-side holding unit can hold and release the upstream side of the sheet S on the standby tray 41. The downstream-side holding unit is arranged at the downstream side of the standby tray 41 in the sheet conveyance direction D. The downstream-side holding unit can hold and release the downstream side of the sheet S on the standby tray 41. The downstream-side holding unit can move the held sheet S to the upstream side in the sheet conveyance direction D. The sheet position detecting unit can detect the position of the sheet S conveyed to the standby unit 21. The control unit performs the sheet conveying process ST1, the downstream-side holding process ST2, the sheet returning process ST3, the upstream-side holding process ST5, the downstream-side release process ST7, and the upstream-side release process ST8. In the sheet conveying process ST1, the sheet S is conveyed to the standby unit 21 and the sheet S is advanced to the downstream side until the sheet S passes the sheet placing position SP on the standby tray 41. In the downstream-side holding process ST2, the sheet S passing the sheet placing position SP in the sheet conveying process ST1 is held in the downstream-side holding unit. In the sheet returning process ST3, the sheet S held in the downstream-side holding process ST2 is returned to the sheet placing position SP by the downstream-side holding unit. In the upstream-side holding process ST5, the sheet S returned to the sheet placing position SP in the sheet returning process ST3 is held in the upstream-side holding unit. In the downstream-side release process ST7, holding of the previous sheet S is released by the downstream-side holding unit before the sheet conveying process ST1 for the next sheet S of second and succeeding sheets. In the upstream-side release process ST8, holding of the previous sheet S by the upstream-side holding unit is released after the downstream-side holding process ST2 for the next sheet S. In the sheet returning process ST3 for the next sheet S after the upstream-side release process ST8, the next sheet S is returned to a position shifted to be closer to the upstream side or the downstream side than the previous sheet S in the sheet placing position SP to shift one end SSa of the sheet bundle SS in a step shape.

With the configuration described above, processing for restraining complication of a device configuration and shifting one end SSa of the sheet bundle SS in a step shape can be achieved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing device comprising:

a standby tray;

a sheet post-processing unit configured to perform a specified post-processing on a sheet bundle held in the standby tray;

a first pressing member configured to press the sheet bundle against the standby tray at a first location of the standby tray;

a second pressing member configured to press the sheet bundle against the standby tray at a second location of the standby tray which is upstream in a sheet conveying direction relative to the first location; and a control unit configured to:

control the first pressing member to press a first sheet conveyed into the standby tray against the standby tray at the first location of the standby tray, cause the first sheet while pressed by the first pressing member to be conveyed upstream in the sheet conveying direction to a first position on the standby tray, control the second pressing member to press the first sheet against the standby tray at the second location of the standby tray while the first sheet is at the first position, control the first pressing member to stop pressing the first sheet against the standby tray, cause a second sheet to be conveyed on top of the first sheet while the first sheet is no longer pressed by the first pressing member and is still pressed by the second pressing member, control the first pressing member to press the second sheet against the standby tray at the first location, and cause the second sheet while pressed by the first pressing member and while the first sheet is pressed by the second pressing member to be conveyed upstream in the sheet conveying direction to a second position on the standby tray that is offset from the first position.

2. The device according to claim 1, further comprising:

a third pressing member configured to press an upstream side of the sheet bundle against the standby tray, wherein the control unit further controls the third pressing member to press the first sheet against the standby tray just before the second pressing member is controlled to press the first sheet against the standby tray at the second location.

3. The device according to claim 2, wherein the third pressing member includes at least one cutout portion, and the second pressing member presses the sheet bundle against the standby tray though the at least one cutout portion when the third pressing member is also pressing the sheet bundle against the standby tray.

4. The device according to claim 3, wherein the second pressing member comprises:

a pressing arm; and a friction member positioned on an end of the pressing arm, the friction member contacting the sheet bundle when the second pressing member presses against the sheet bundle.

5. The device according to claim 1, wherein the first pressing member comprises a pair of rollers.

6. The device according to claim 5, wherein the control unit causes the first sheet to be conveyed upstream in the sheet conveying direction by controlling one of the rollers to rotate in a predetermined direction for a predetermined duration.

7. The device according to claim 1, wherein the sheet post-processing unit is a tape binding unit configured to bind the sheet bundle with tape on an upstream edge thereof.

8. The device according to claim 1, further comprising:

a processing tray below the standby tray and in which the sheet bundle is held when the sheet post-processing unit performs the specified processing on the sheet bundle.

9. The device according to claim 8, wherein the standby tray comprises two movable tray portions configured to move relative to each other between a closed position in which the sheet bundle is supported thereby and an open position in which the sheet bundle is substantially not supported thereby.

10. The device according to claim 9, further comprising:

a paddle configured to push the sheet bundle from the standby tray to the processing tray when the moveable tray portions are in the open position.

11. A sheet processing method comprising the steps of:

pressing a first sheet conveyed into a standby tray against the standby tray at a first location of the standby tray;

while the first sheet is being pressed, conveying the first sheet upstream in a sheet conveying direction to a first position on the standby tray;

while the first sheet is at the first position, pressing the first sheet against the standby tray at a second location of the standby tray which is upstream in a sheet conveying direction relative to the first location;

stopping the pressing of the first sheet against the standby tray at the first location;

conveying a second sheet on top of the first sheet while the first sheet is no longer pressed at the first location and is still pressed at the second location;

pressing the second sheet against the standby tray at the first location; and while the second sheet is pressed at the first location and while the first sheet is pressed at the second location, conveying the second sheet upstream in the sheet conveying direction to a second position on the standby tray that is offset from the first position.

12. The method according to claim 11, further comprising the step of:

pressing an upstream side of the first sheet against the standby tray just before the first sheet is pressed against the standby tray at the second location.

13. The method according to claim 12, wherein the first sheet is pressed on the upstream side thereof with a pressing member that has at least one cutout portion and a force for pressing the first sheet against the standby tray at the second location is applied to the first sheet through the at least one cutout portion.

14. The method according to claim 13, wherein the force for pressing the first sheet against the standby tray at the second location is applied using a pressing arm and a friction member positioned on an end of the pressing arm that contacts the first sheet.

15. The method according to claim 11, wherein the first sheet is pressed against the standby tray at the first location using a pair of rollers.

16. The method according to claim 15, wherein the first sheet is conveyed upstream in the sheet conveying direction by controlling one of the rollers to rotate in a predetermined direction for a predetermined duration.

17. The method according to claim 11, further comprising the step of:

binding a sheet bundle comprising the first and second sheets on an upstream side thereof with tape.

18. The method according to claim 17, wherein a processing tray supports the sheet bundle when the sheet bundle is bound with tape.

19. The method according to claim 18, wherein the standby tray comprises two movable tray portions configured to move relative to each other between a closed position in which the sheet bundle is supported thereby and an open position in which the sheet bundle is substantially not supported thereby.

20. The method according to claim 19, further comprising the step of:

pushing, with a paddle, the sheet bundle from the standby tray to a processing tray when the moveable tray portions are in the open position.

* * * * *